US006590192B2

(12) United States Patent
Taino et al.

(10) Patent No.: US 6,590,192 B2
(45) Date of Patent: Jul. 8, 2003

(54) MICROWAVE OVEN WITH TEMPERATURE-DEPENDENT AUTOMATIC STOP

(75) Inventors: Kazuo Taino, Shiga (JP); Hiroyasu Kitagawa, Shiga (JP); Kazuko Tanaka, Shiga (JP); Yoshiko Yamane, Kusatsu (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 0 days.

(21) Appl. No.: 10/084,126

(22) Filed: Feb. 26, 2002

(65) Prior Publication Data

US 2002/0158065 A1 Oct. 31, 2002

(30) Foreign Application Priority Data

Feb. 28, 2001 (JP) ..... 2001-055037

(51) Int. Cl.[7] ..... H05B 6/68

(52) U.S. Cl. ..... 219/710; 219/711; 219/748; 219/749; 99/325; 374/149

(58) Field of Search ..... 219/711, 710, 219/746, 748, 749, 756, 492; 99/325; 374/149

(56) References Cited

U.S. PATENT DOCUMENTS 5,919,389 A * 7/1999 Uehashi et al. ..... 219/711
5,986,249 A 11/1999 Yoshino et al. ..... 219/746
6,229,130 B1 * 5/2001 Furuta et al. ..... 219/711
6,376,812 B2 * 4/2002 Yamada et al. ..... 219/711

FOREIGN PATENT DOCUMENTS

JP 9-72549 * 3/1997

* cited by examiner

*Primary Examiner*—Philip H. Leung
(74) *Attorney, Agent, or Firm*—Darby & Darby

(57) ABSTRACT

A microwave oven determines an appropriate time to stop heating even if multiple food items are placed in the heating chamber. After any position on the bottom surface of the microwave oven reaches 75 deg C., a search is made for any other position having a temperature of at least 70 deg C. If such a position is detected, heating is concentrated on that position until it reaches 75 deg C. When all food-containing positions in the microwave oven have reached a temperature of at least 75 deg C., the heating operation performed by the magnetron is stopped.

9 Claims, 22 Drawing Sheets

FIG.6A
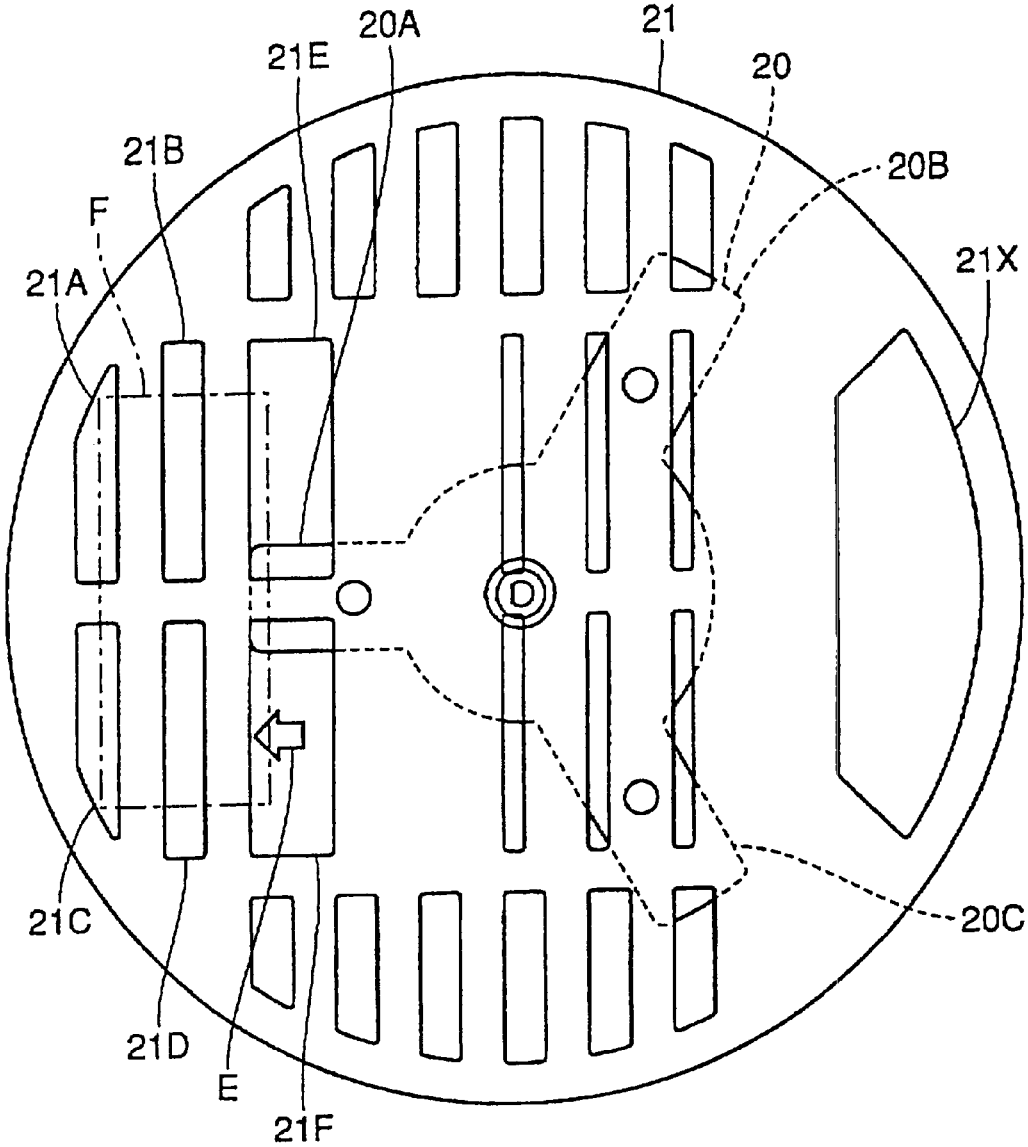
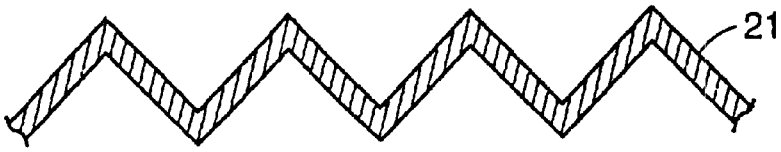
FIG.6B

| FIG.18A | FIG.18B |
|---|---|

CUSTOM TEMP OPTION
BEGIN HEATING AT OUTPUT BASED ON TEMP. BEGIN TEMP SEARCH
SEARCH TEMP: S
S1701
DETERMINE TRAY TEMP
TRAY TEMP: To
S1702
To < 40°C ?
S1703
NO
YES
CORRECT SENSOR OUTPUT
S1704
STORE TEMP SETTING
Sset
S1705
Sset ≦10°C ?
S1706
NO
YES
BEGIN HEATING AT 60 W BEGIN SEARCH
S1707
Sset ≦45°C ?
S1714
NO
YES
Sset ≦90°C ?
S1716
NO
YES
DISPLAY ERROR
S1725
RETURN
HEAT AT MAX OUTPUT BEGIN SEARCH
S1718
Sset ≦80°C ?
S1719
NO
YES
Tmax ← 7
S1720
Tmax ← 11
S1721

MICROWAVE OVEN WITH TEMPERATURE-DEPENDENT AUTOMATIC STOP

BACKGROUND OF THE INVENTION

The present invention relates to a microwave oven. More specifically, the present invention relates to a microwave oven that automatically ends a heating operation by detecting the temperature of the food in the heating chamber.

In a conventional microwave oven described in Japanese patent number 2,998,607, detection of the temperature of the food in the heating temperature is performed continuously. Heating is stopped automatically when the food reaches a predetermined temperature. More specifically, when the maximum temperature of the food in the heating chamber reaches a predetermined temperature, i.e., when the difference between the maximum temperature and the minimum temperature of the detection outputs at multiple positions in the heating chamber are at or greater than a predetermined value, the heating is determined to be finished and the heating operation is stopped.

However, in some cases food may be arranged over a relatively wide area in the heating chamber, e.g., when multiple pieces of food are placed in the heating chamber. In these cases, stopping the heating operation as described above for conventional microwave ovens can result in some oft food not being completely heated. This occurs because some of the food may not be completely heated in some locations even when the heating operation is finished for one or more other position inter heating chamber. Also, even for similar foods, the degree of heating that takes place may vary according to the arrangement of the food. This problem is compounded when foods of different types are loaded into the heating chamber.

OBJECTS AND SUMMARY OF THE INVENTION

It is an object of the present invention to provide a microwave oven which overcomes the problems of the prior art.

It is a further object of the invention to provide a microwave oven that can determine an appropriate time to stop heating even when food is arranged at multiple locations within the heating chamber.

It is a still further object of the invention to provide a microwave oven that can determine an appropriate time to stop heating based on a detected lowest food temperature in the heating chamber.

According to one aspect of the present invention, a microwave oven includes: a heating chamber holding food; a magnetron oscillating microwaves to heat the food; a temperature detector detecting temperatures at a plurality of locations in the heating chamber; a controller controlling heating operation of the magnetron based on detection output from the temperature detector. The controller includes: a first evaluation module evaluating whether a maximum temperature in the heating chamber detected by the temperature detector has reached a predetermined value when the magnetron is performing the heating operation; a second evaluation module which, if the first evaluation module determines that the maximum temperature in the heating chamber has reached the predetermined temperature, determines whether there is a particular position, other than the position that reached the predetermined temperature, in the heating chamber that has not reached at least a predetermined temperature lower than the predetermined temperature; a heating operation stopping module which, if the second evaluation module determines that there is the particular position, stops the heating operation of the magnetron when a temperature of the particular position reaches the predetermined temperature.

As a result, if multiple food items are disposed in the heating chamber, heating operations are continued until all the food is sufficiently heated rather than just one food item.

Thus, an appropriate time to end heating is determined even with multiple food items placed in the microwave oven at the same time.

In the microwave oven of the present invention, it is preferable to further include a main unit storage module storing information, disposed separately from the temperature detector. The temperature detector includes an infrared sensor and a correction information storage module storing information used to correct the detected temperature from the infrared sensor. The controller stores storage contents of the correction information storage module in the main unit storage module when a first operation is performed.

As a result, in this microwave oven, the controller stores the storage contents of the correction information storage module in the main unit storage module the first time the microwave oven is operated. This allows the infrared sensor to operate regardless oft durability of the correction information storage module.

This allows the use of low durability in the correction information storage module and thus reduces the cost of the correction information storage module. As a result, the cost of the microwave oven is reduced.

In the microwave oven of the present invention, it is preferable to further include a temperature detection controller controlling the temperature detector to repeatedly change the position at which temperature detection is performed using a predetermined pattern. While the magnetron is performing heating operations, operation of other elements associated with the heating operation are synchronized by the controller with a start of execution by the temperature detection controller of temperature detection according to the predetermined pattern.

As a result, the temperature detector detects temperatures under the same condition each time the predetermined pattern is executed.

In the microwave oven of the present invention, it is preferable for the controller to further include a placement position determining module which, when a temperature detected by the temperature detector is outside a certain range, determines a food placement position, i.e., a position at which the temperature was detected. If the temperature at the food placement position is lower than a predetermined temperature below a normal temperature, the temperature detection controller keeps the position at which the temperature detector module detects the temperature at the food placement position while the magnetron is performing heating operations.

As a result, even if the food has a low temperature, it is possible to avoid the detected food temperature being influenced by higher surrounding temperatures.

In the microwave oven of the present invention, it is preferable for the temperature detector to apply correction to temperatures at a plurality of positions in the heating chamber based on a temperature at a position in the heating chamber which does not contain food when the magnetron begins heating operations. This procedure relies on the fact that, in the absence food at a particular location in the oven chamber, the non-food target area, is not heated substantially by microwave energy. Thus, the correction temperature provides a baseline temperature.

In the microwave oven of the present invention, it is preferable for the temperature detector to detect temperatures at a plurality of positions in the heating chamber using as a reference the temperature detected at a start of the heating operation oft magnetron from a position in the heating chamber at which food is absent.

As a result, in this microwave oven, the environmental temperature of the heating chamber at the start of the heating operation is reflected in the detection output of the temperature detector.

Thus, the detection output of the temperature detector is based on the state of the microwave oven when the heating operation was started. In other words, the precision of the detection output is not affected by the internal temperature of the microwave oven at the start of the heating operation.

In the microwave oven of the present invention, it is preferable to have the following: when the heating operation by the magnetron is started, the controller disables the detection output of the temperature detector for a location at which the temperature detector detects a temperature of at least a predetermined value.

As a result, in the microwave oven, if a section of the heating chamber has a high temperature at the start of a heating operation even in the absence of food in that location, the microwave oven is prevented from mistakenly assuming that sufficiently heated food is located at that section.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 6(A) is a plan drawing with the auxiliary antenna and the rotating antenna from the microwave oven of FIG. 1 in an overlapped state.

FIG. 6(B) is a cross section of a region F of FIG. 6(A)

DETAILED DESCRIPTION OF THE PREFERRED EMBODIMENTS

Figure 1:
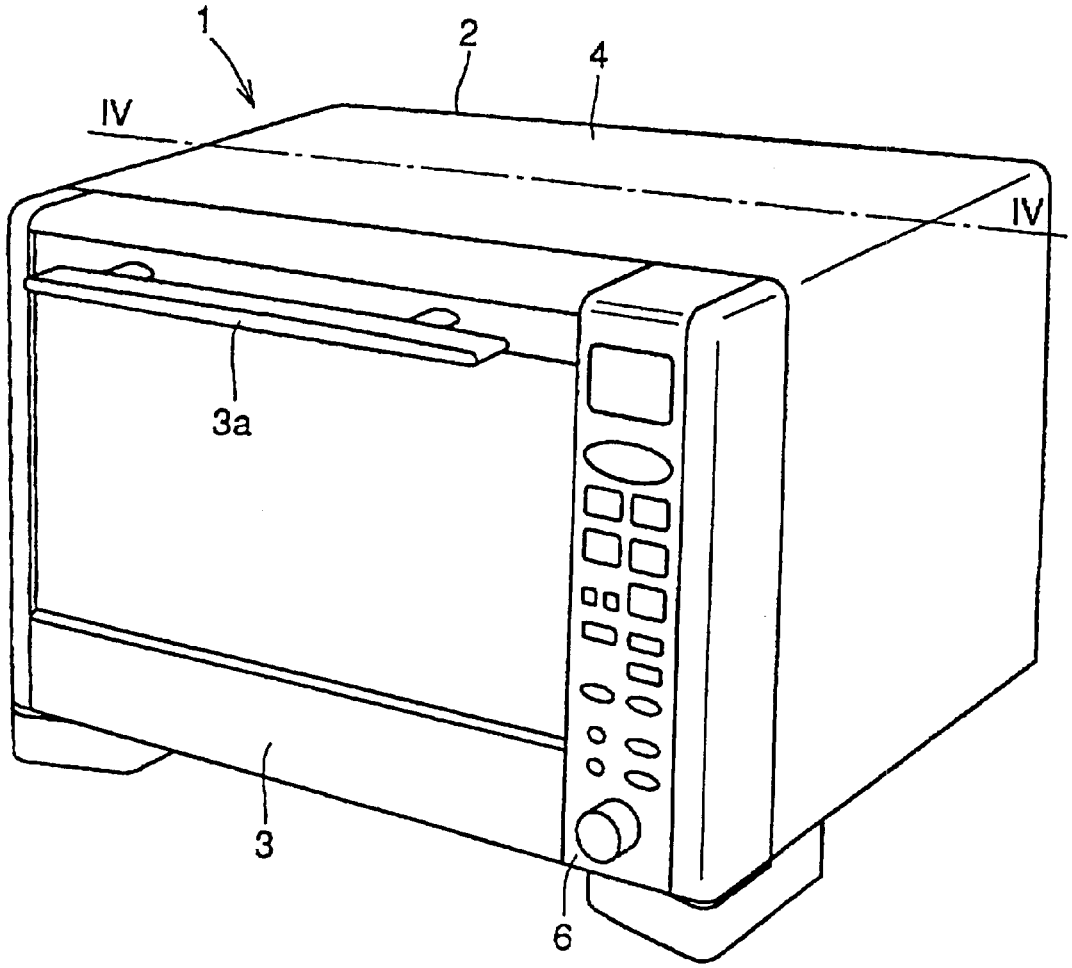
FIG. 1 is a perspective drawing of a microwave oven according to an embodiment of the present invention.

Referring to FIG. 1, a microwave oven 1, according to the invention, is essentially a main unit 2 with its front closed by a door 3. An outer covering 4 encloses the main unit 24. An input panel 6 is disposed on the front of the main unit 2 to allow the user to enter various types of information into the microwave oven 1. Also, the main unit 2 is supported on a plurality of feet (not numbered).

The door 3 is pivoted at its bottom to permit it to open and close. A handle 3*a* is disposed at the upper part of the door 3.

Figure 2:
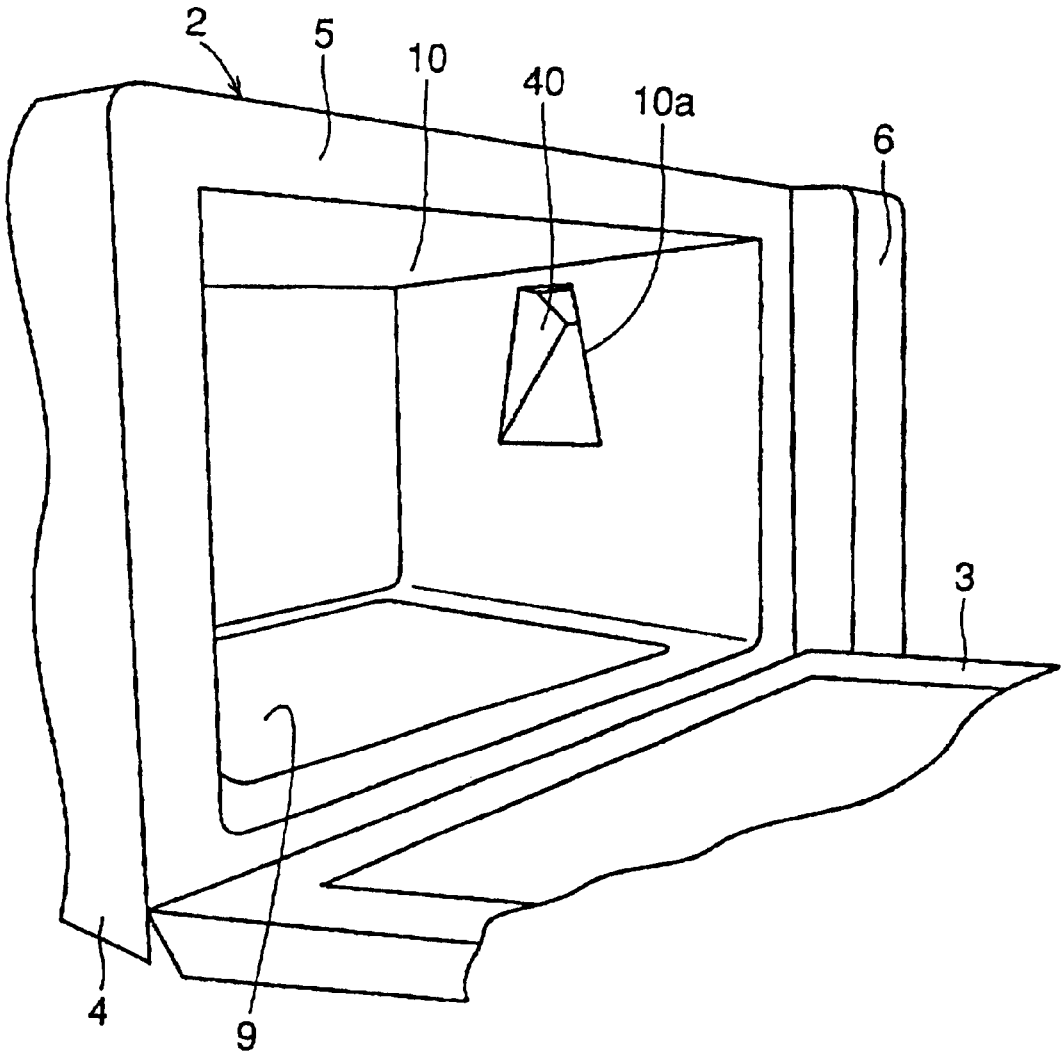
FIG. 2 is a perspective drawing of the microwave oven of FIG. 1 viewed through its opened door.

Referring to FIG. 2, a main unit frame 5 is disposed inside the main unit 2. The main unit frame 5 contains a heating chamber 10. A hole 10*a* is formed on the upper part of the right side surface of the heating chamber 10. A detection path member 40 is connected to the hole 10*a* from the outside of the heating chamber 10. A bottom plate 9 forms the bottom surface of the heating chamber 10.

Figure 3:
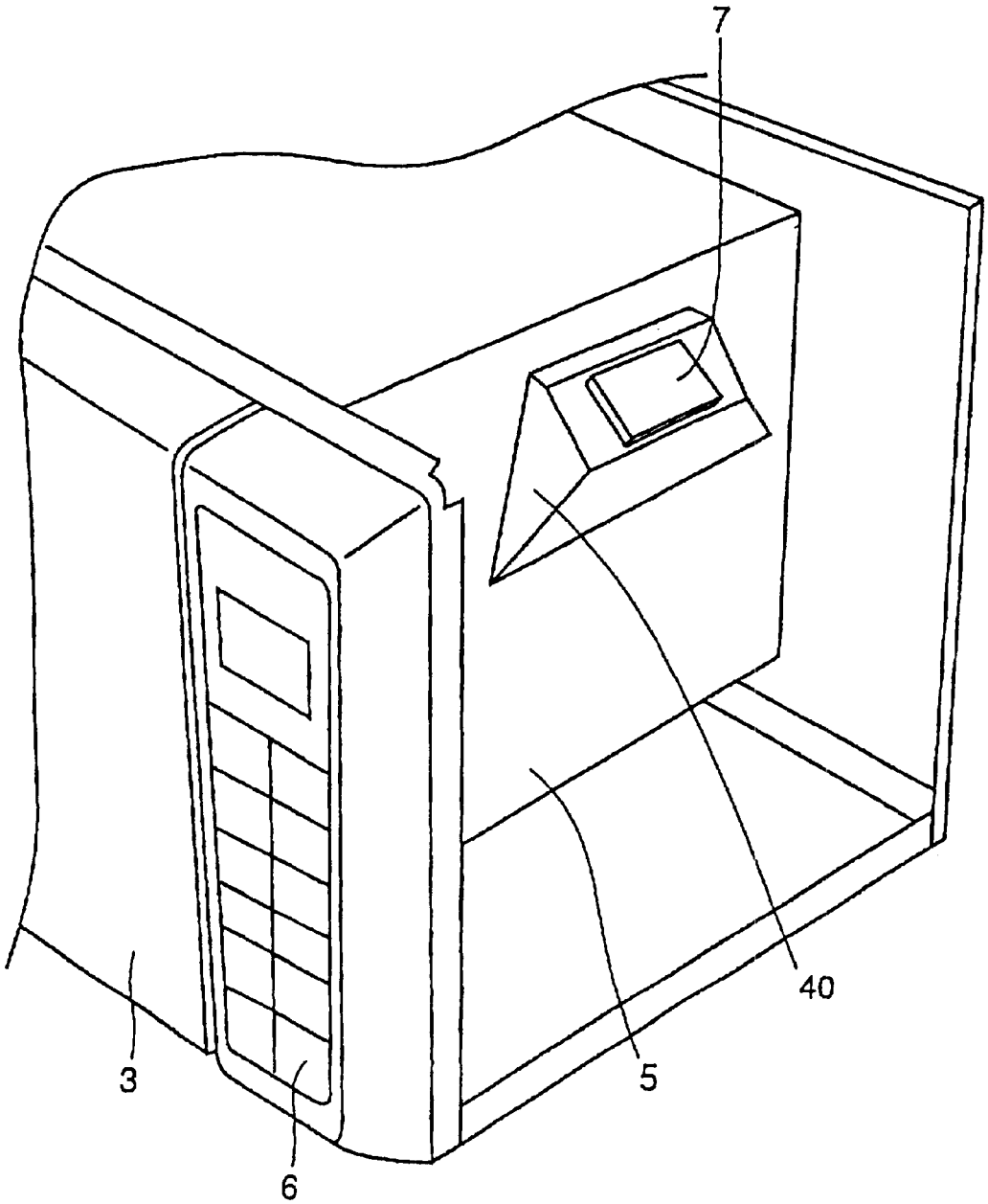
FIG. 3 is a perspective drawing of the microwave oven of FIG. 1 with the outer cover removed.
Figure 4:
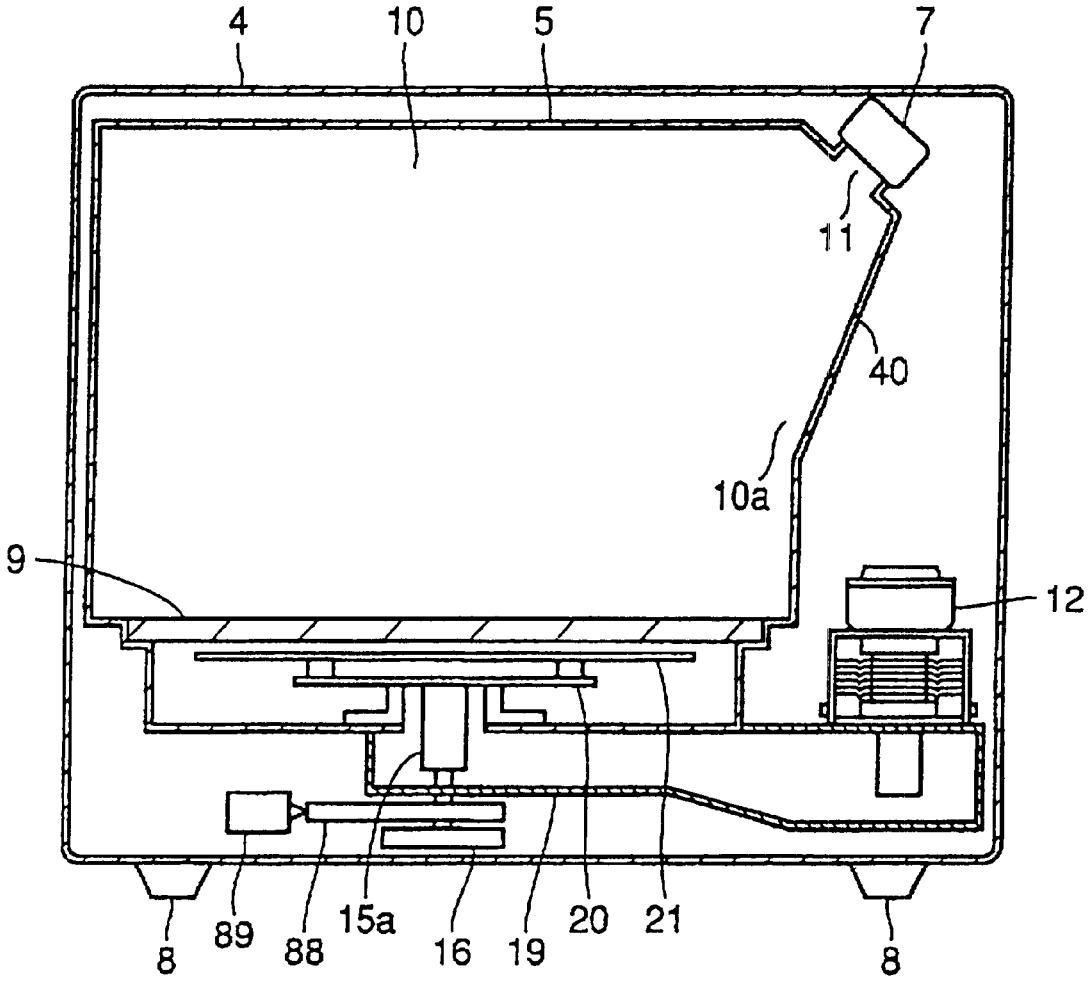
FIG. 4 is a cross-section drawing along the IV—IV line of the microwave oven of FIG. 1.

Referring to FIGS. 3 and 4, a magnetron 12, as well as other parts, are mounted on the right side surface of the main unit frame 5 adjacent to the heating chamber 10. The detection path member 40, formed like a box, is connected to the hole 10*a,* includes an opening and is formed as a box with this opening connected to the hole 10*a.* An infrared sensor 7 is positioned at the end surface of the box-shaped detection path member 40. A detection window 11 opens from the end of the box shape the detection path member 40 to the infrared sensor 7. The infrared sensor 7 receives infrared radiation originating in the heating chamber 10 through the detection window 11.

The magnetron 12 is disposed inside the outer covering 4 adjacent below and to the right of the heating chamber 10. A waveguide 19 is disposed below the heating chamber 10 to connect microwave energy from the magnetron 12 to the bottom of the main unit frame 5.

A rotating antenna 20 is disposed between the bottom of the main unit frame 5 and the bottom plate 9. An antenna motor 16 below the waveguide 19 is connected by a shaft 15*a* to the rotating antenna 20. The antenna motor 16 is driven to rotate the rotating antenna 20.

Food is placed on the bottom plate 9 in the heating chamber 10. The microwaves emitted from the magnetron 12 pass along the waveguide 19 and are fed to the heating chamber 10. The microwaves are dispersed throughout the heating chamber by the rotating antenna 20. Food on the bottom plate 9, particularly food containing water, is heated as a result.

A heater unit, not shown in the figure, is disposed behind the heating chamber 10. The heater unit contains a heater 13 (shown in FIG. 11) and a fan to efficiently send the heat generated by the heater into the heating chamber 10. A heater is also disposed above the heating chamber 10 to provide searing on the surface of the food.

An auxiliary antenna 21 is attached to the rotating antenna 20. The rotating antenna 20 and the auxiliary antenna 21 are flat. The auxiliary antenna 21 and the rotating antenna 20 are attached to each other by insulators, to insulate them from each other. The rotating antenna 20 is attached to the upper end of the shaft 15*a*.

A switch 89 is attached below the rotating antenna 20. A cam 88, rotating with the rotating shaft 15*a*, actuates the switch 89 each time the rotating antenna 20 makes one rotation. The cam 88 maybe replaced by any convenient mechanism for actuating the switch 89 in a fixed ratio to rotations of the rotating antenna 20.

Figure 5:
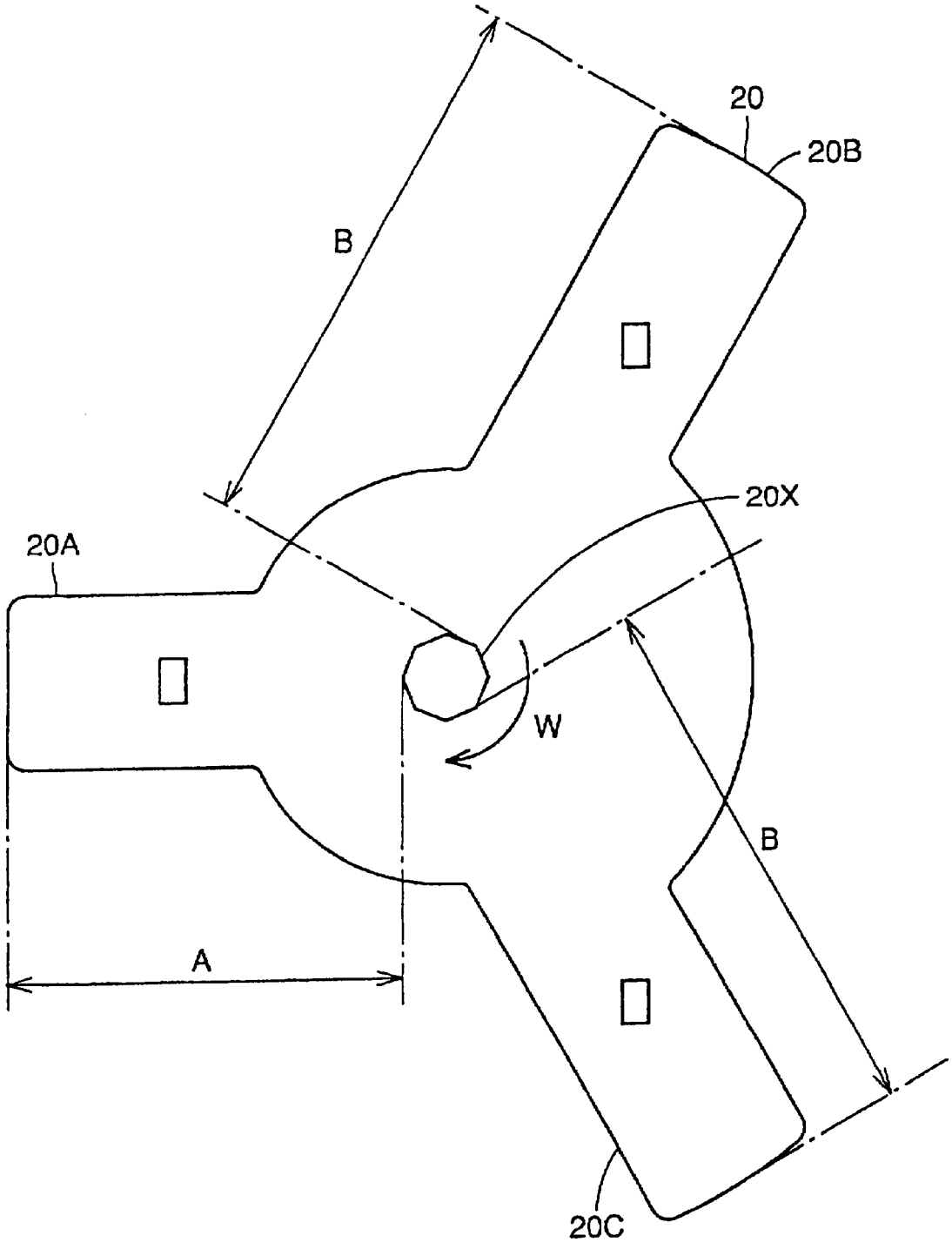
FIG. 5 is a plan drawing of the rotating antenna of the microwave oven of FIG. 1.

Referring to FIG. 5, the rotating antenna 20 includes a hexagonal hole 20X at its center for connecting to the shaft 15*a*. Sectors 20A–20C, on the rotating antenna 20, extending radially outward with respect to the hole 20X. A distance A of the end of the section 20A from the hole 20X is approximately 60 mm. A distance B of the end of the sections 20B and 20C from the hole 20X is approximately 80 mm. The distance A corresponds to approximately ½the wavelength of the microwave oscillation from the magnetron 12.

Referring now to FIG. 6(A), the auxiliary antenna 21 is secured to the rotating antenna 20 so that it is rotated at the same rate as the rotating antenna 20. Also, slits 21A–21F are formed near the section 20A of the auxiliary antenna 21. The slits 21A–21F are oriented with their long dimensions perpendicular to the primary propagation direction of the microwave (arrow E in FIG. 6(A)). As a result, microwaves are radiated forcefully from the slits 21A–21F. Microwaves are radiated especially forcefully from slits 21B, 21D, 21E, and 21F by giving these slits a length of approximately 55 mm–60 mm (on the order of a half wavelength of the microwave energy).

In the microwave oven 1, when the rotating antenna 20 and the auxiliary antenna 21 are stopped, the slits 21A–21F are positioned toward the door 3 in the heating chamber 10. As a result, when these antennae are stopped and the magnetron 12 is active, food placed toward the front in the heating chamber 10 receives concentrated microwaves, thus allowing efficient heating. It is desirable to provide an indication in the vicinity of the slits 21A–21F (a region F in FIG. 6(A)) of the auxiliary antenna 21 by making the auxiliary antenna 21 visible from inside the heating chamber 10. Such visibility can be enabled by making the bottom plate 9 transparent. This indication can be in the form of the words "Power zone" or the like to indicate that concentrated heating will take place in this location. Alternatively, the surface for the corresponding section can be formed with a zigzag shape (i.e., as shown in the cross section in FIG. 6(B)).

A hole 21X is formed on the auxiliary antenna 21 at a region symmetrical to the region F.

The rotating antenna 20 is attached to the upper end of the shaft 15*a* by locking onto the upper end of the shaft 15*a*. The cross section of the locking section is polygonal rather than circular. Referring to FIG. 5, the cross section of the hole 20X is also formed with an octagonal shape. Since the cross-section where the shaft 15*a* is locked is polygonal, the rotating antenna 20 is prevented from slipping relative to the shaft 15*a* when the shaft 15*a* rotates so that the rotating antenna 20 turns in the direction of the arrow W. Thus, by controlling the rotation angle of the shaft 15*a*, the rotation angle of the rotating antenna 20 is reliably controlled.

2. The Field of View of the Infrared Sensor

Figure 7:
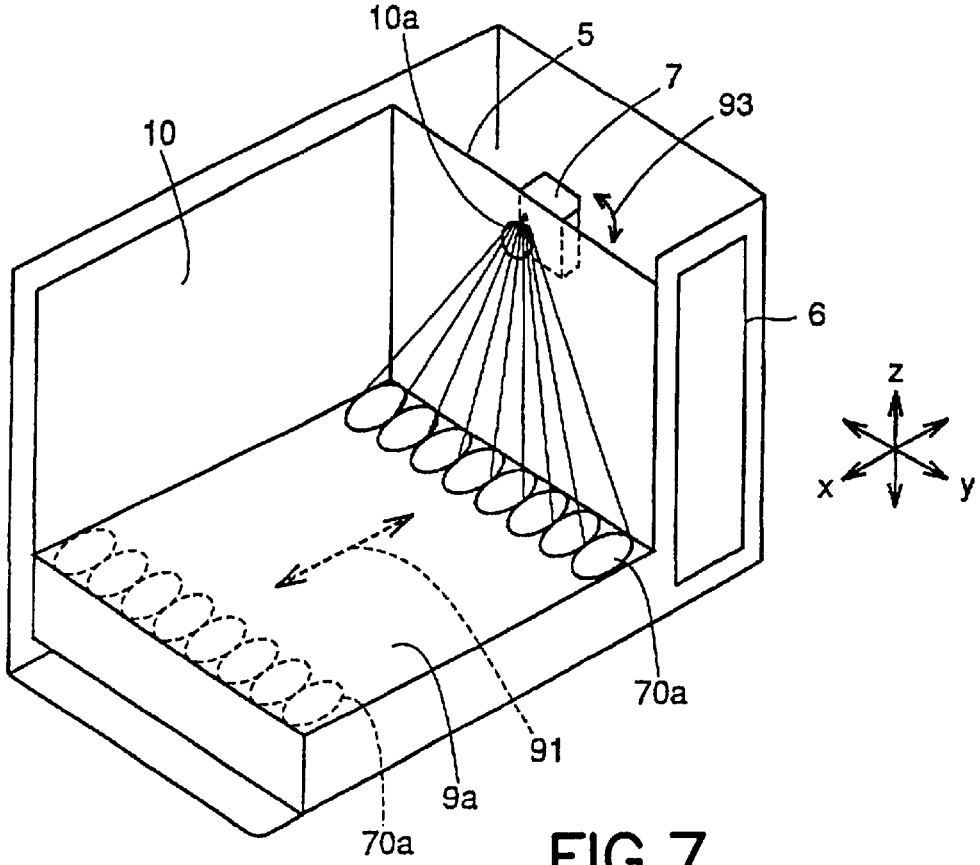
FIG. 7 is a drawing showing sample fields of view of an infrared sensor in the microwave oven of FIG. 1.

Referring now to FIG. 7, the infrared sensor 7 includes a plurality of infrared detection sensors 7*a* (infrared detection elements 7*a* in FIG. 11) to convert absorbed infrared rays to data. The infrared detection sensors 7*a* are formed as a row of infrared detection elements extending along the depth axis of the heating chamber 10. In the following description, the field of view of the infrared sensor 7 refers to the combined fields of view of the plurality of infrared detection elements. The lateral axis of the heating chamber 10 is defined as the x axis, the depth axis as the y axis and the height axis as the z axis. These three axes are perpendicular to one another.

The infrared sensor 7 is formed with eight infrared detection elements arranged along the y axis. Because the infrared sensor 7 includes eight infrared detection elements, eight fields of view 70*a* are simultaneously projected over the bottom surface 9*a* (including the bottom plate 9) on the indicated solid line along the y axis. The bottom surface 9*a* is covered by the eight fields of view 70*a* from one end of the y direction to the other end across a certain region along the x axis.

The microwave oven 1 includes a member (a moving section 72 described later, shown in FIG. 11) that rotate the infrared sensor 7 in the direction of arrows 93. The arrows 93 indicate translation of the fields of view 70*a* along the x-z plane.

As the infrared sensor 7 is rotated in the direction indicated by the arrows 93, the positions of the fields of view projected on the bottom surface 9*a* move in the direction of an arrow 91 (along the x axis, laterally relative to the heating chamber 10). More specifically, the fields of view 70*a* move within the range from the fields of view 70*a* indicated by the solid lines to the fields of view 70*a* indicated by the dotted lines.

Figure 8:
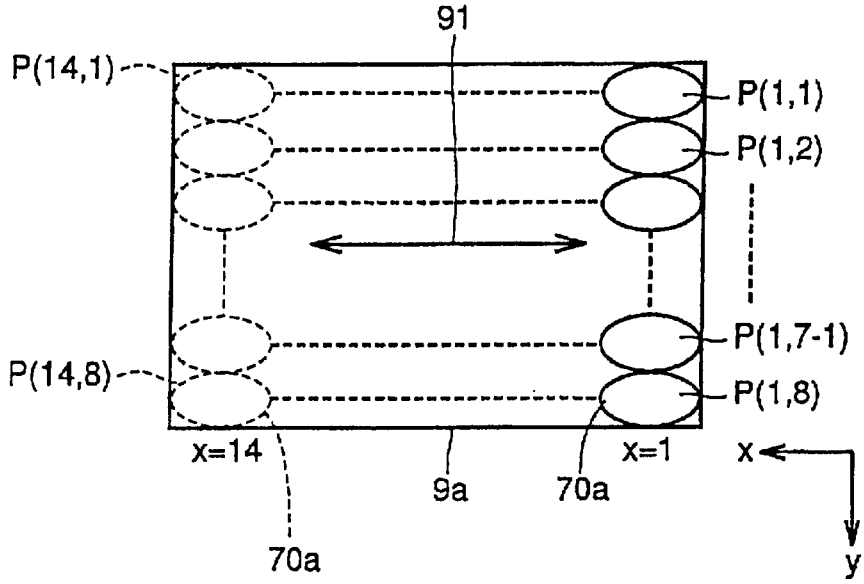
FIG. 8 is a simplified drawing showing the motion on the bottom surface of the heating chamber of the fields of view of the infrared detection elements of the example in FIG. 7.

Referring to FIG. 8, a simplified drawing shows how the fields of view 70*a* move over the bottom surface 9*a*. The x axis and the y axis shown in FIG. 8 are the same as those shown in FIG. 7. There are, for example, 14 points along the x axis on the bottom surface 9*a* at which temperature data from the 8 fields of view along the y axis may be taken. Using a coordinate format where P(x, y) is the position of the fields of view 70*a* of the eight infrared detection elements on the bottom surface 9*a*, the fields of view move in the following ranges: P(1,1)–P(14,1), P(1,2)–P(14,2), P(1,3)–P(14,3), P(1,4)–P(14,4), P(1,5)–P(14,5), P(1,6)–P(14,6), P(1,7)–P(14,7), P(1,8)–P(14,8).

Figure 9:
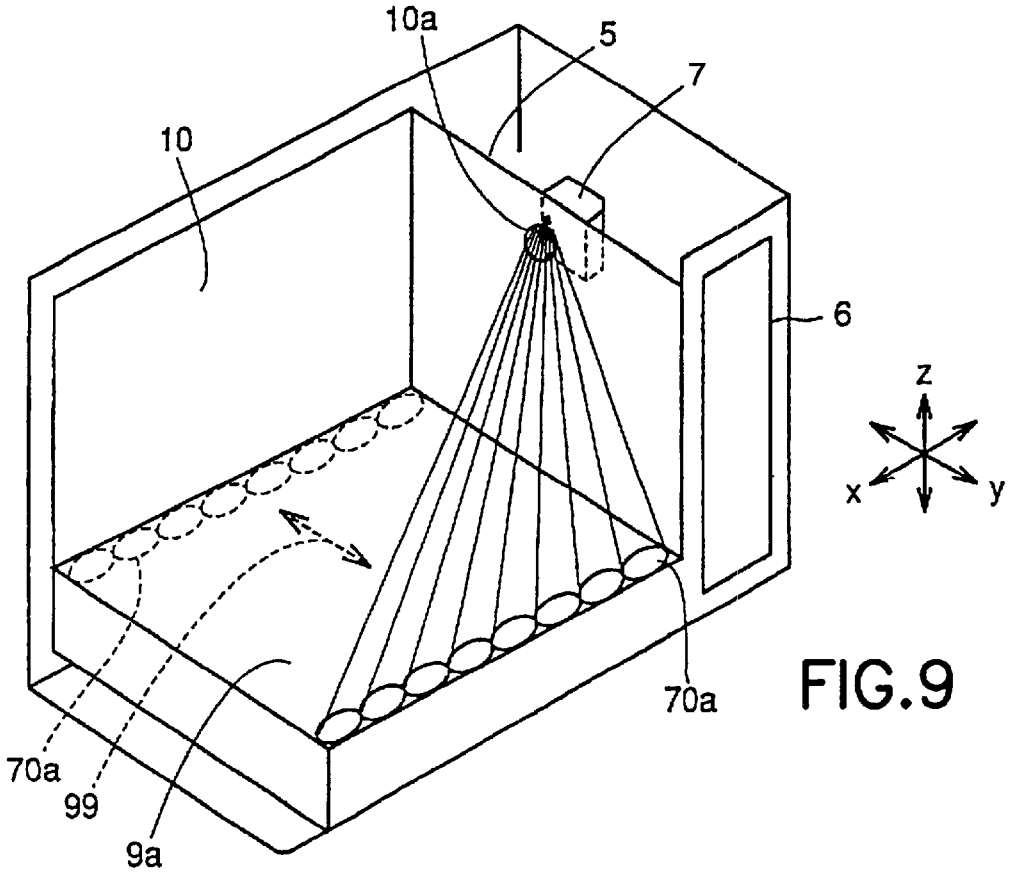
FIG. 9 is a drawing showing another example of the fields of view of the infrared sensor in the microwave oven of FIG. 1.
Figure 10:
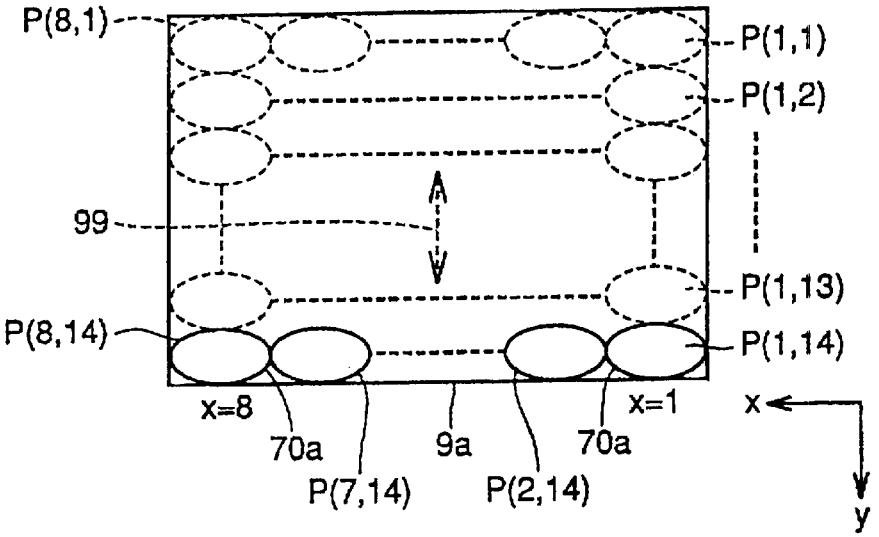
FIG. 10 is a simplified drawing showing the motion on the bottom surface of the heating chamber of the fields of view of the infrared detection elements.

Referring to FIGS. 9 and 10, in an alternative embodiment, the fields of view of the infrared sensor 7 are formed by a row of 8 infrared detection elements arranged along the lateral direction of the heating chamber 10. The x axis, the y axis, and the z axis are the same as in FIG. 7.

When the infrared sensor 7 is moved by the moving section 72 (see FIG. 11, described later), the fields of view 70*a* projected on the bottom surface 9*a* move along the directions of the arrows 99 (along the y axis, i.e., depthwise relative to the heating chamber 10). More specifically, as the infrared sensor 7 is moved, the fields of view 70*a* move from the fields of view 70*a* indicated by the solid lines at the front to the fields of view 70*a* indicated by the dotted lines at the rear.

FIG. 10 shows how the fields of view 70*a* move over the bottom surface 9*a* for the microwave oven 1 using the infrared sensor 7 shown in FIG. 9. The x axis and the y axis shown in FIG. 10 are the same as those shown in FIG. 9. There are, for example, 8 points along the x axis on the bottom surface 9*a* and 14 points along the y axis. Using a coordinate format where P(x, y) is the position of the fields of view 70*a* of the eight infrared detection elements on the bottom surface 9*a,* the fields of view move in the following ranges: P(1,1)–P(1, 14), P(2,1)–P(2, 14), P(2,1)–P(2, 14), P(3,1)–P(3, 14), P(4,1)–P(4, 14), P(5,1)–P(5, 14), P(6,1)–P(6, 14), P(7,1)–P(7, 14), P(8,1)–P(8, 14).

3. Control Block Diagram

Figure 11:
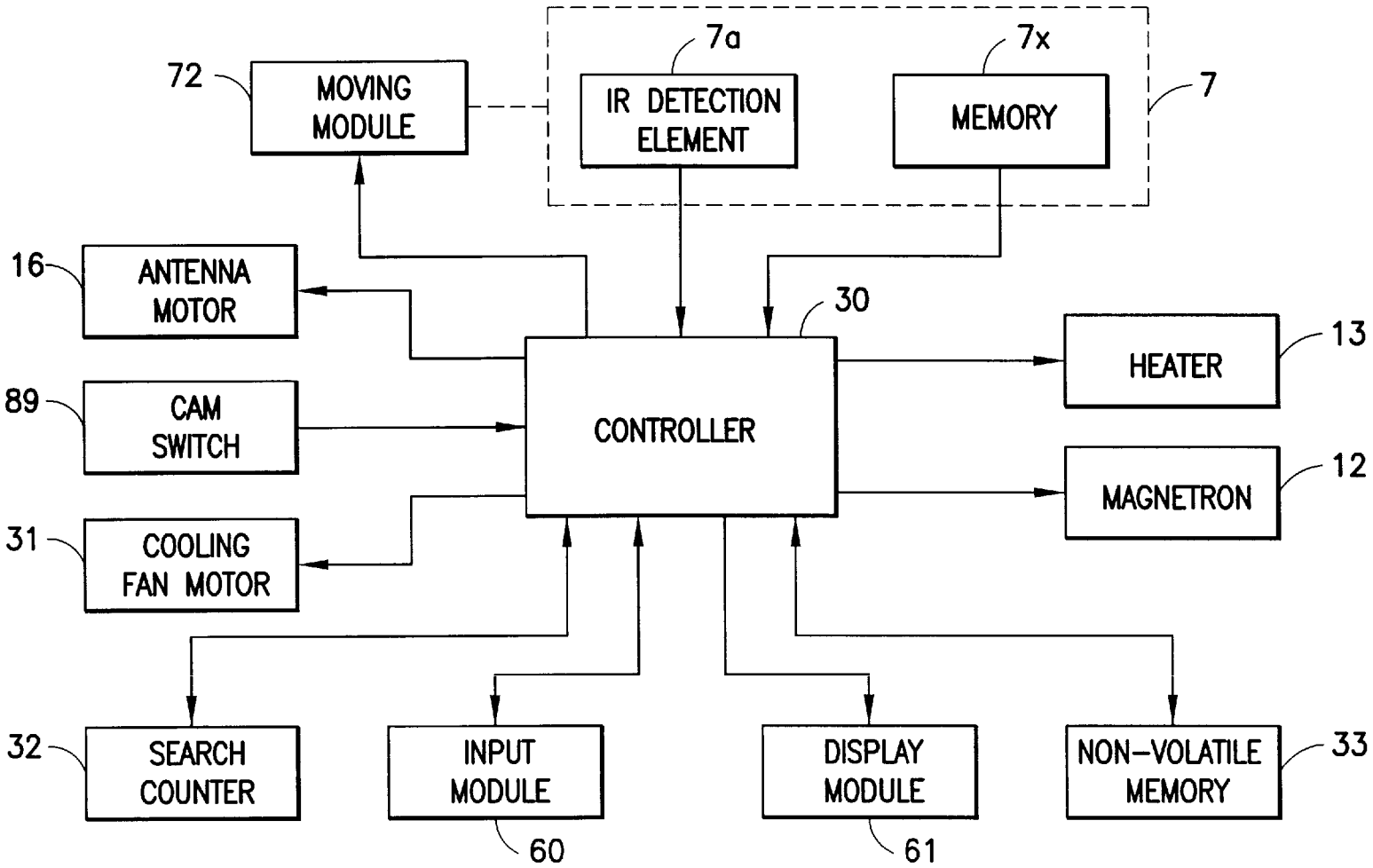
FIG. 11 is a control block diagram of the microwave oven of FIG. 1.

Referring to FIG. 11, a controller 30 provides overall control of the operations of the microwave oven 1. The controller 30 contains a microprocessor. The controller 30 receives information from an input module 60 and the infrared sensor 7. The input module 60 receives the information entered from the input panel 6 to the controller 30. Based on the received information and the like, the controller 30 controls the operations of the antenna motor 16, a cooling fan motor 31, a display module 61, the moving section 72, the magnetron 12, and the heater 13. The display module 61 is a display device, such as an LCD or LED, disposed in the input panel 6.

Returning now to FIGS. 9 and 10, the infrared sensor 7 sends to the controller 30 position information of its fields of view in the heating chamber and temperature information corresponding to this position information. The infrared sensor 7 associates the position information along the lateral axis of the heating chamber 10 with the individual infrared detection elements and outputs the information from channels (CH) 1–8. CH1–CH8 correspond to the lateral coordinates (1–8) of the heating chamber 10. From each channel, the position information along the depth axis is output in terms of the coordinate values (1–14) defined for the depth axis.

Figure 12:
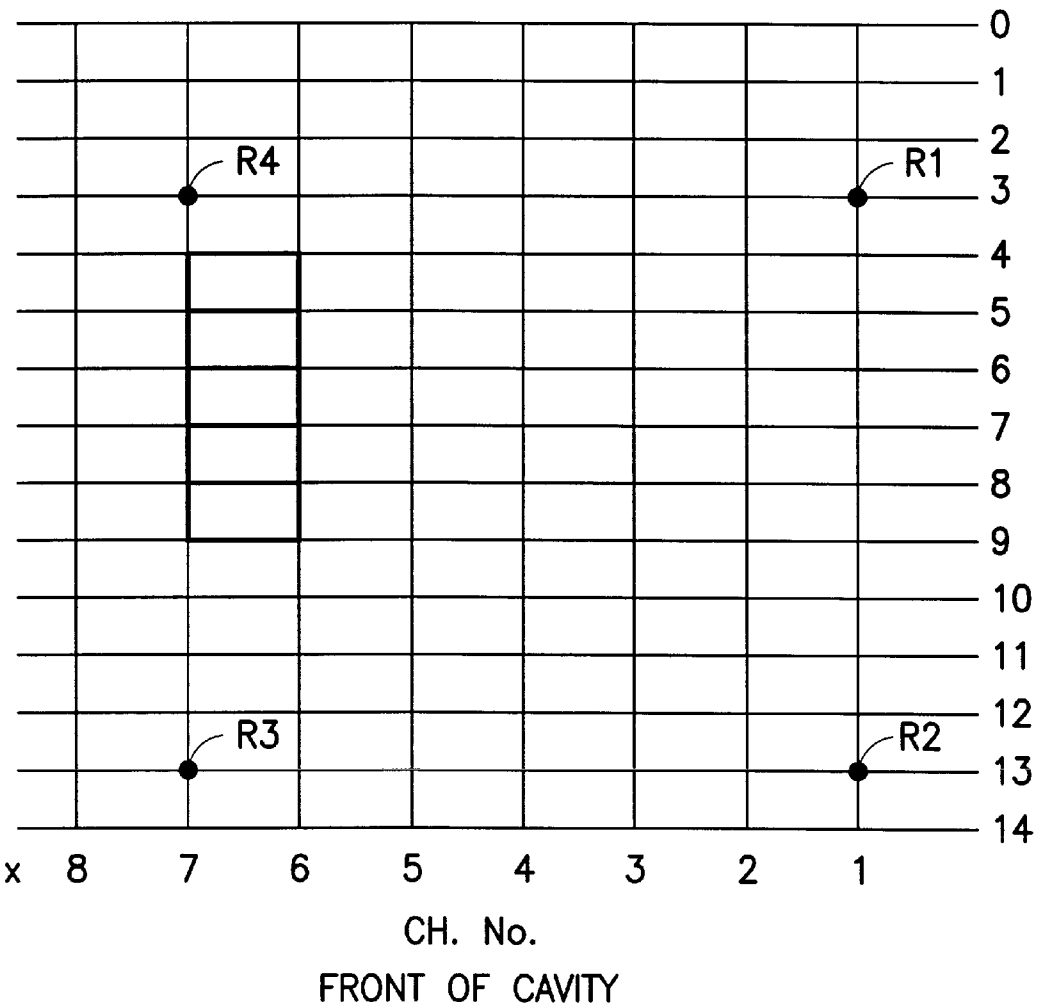
FIG. 12 is a drawing showing the coordinates defined on the bottom surface of the heating chamber in association with position information output from the infrared sensor to the controller in the microwave oven of FIG. 1.

Referring to FIG. 12, there is shown how the coordinates are defined when the position information output from the infrared sensor 7 is shown relative to the bottom surface 9*a* of the heating chamber 10. The horizontal axis is defined as the x axis and the vertical axis is defined as the y axis. This x axis and y axis correspond to the axes in FIG. 9 and FIG. 10. CH1–8 are defined going from right to left of the heating chamber 10, and the y coordinates 1–14 are defined going from the back of the heating chamber 10 to the front. Points R1, R2, R3, and R4 are set up respectively at y coordinates 3 and 13 of CH3, and y coordinates 13 and 3 of CH7. These four points are positioned at the left and right comers of the front of the heating chamber 10 and the left and right corners at the back of the heating chamber 10. These positions are chosen because it can be said to be positions where it is usually difficult to place food. At the beginning of heating operation of the magnetron 12, the temperatures detected at these four points are used as the temperature (tray temperature) of the bottom surface 9*a* at which food is absent. Of the four measured temperatures, the maximum and minimum values are eliminated and the two remaining values are averaged and used as the tray temperature.

Figure 13:
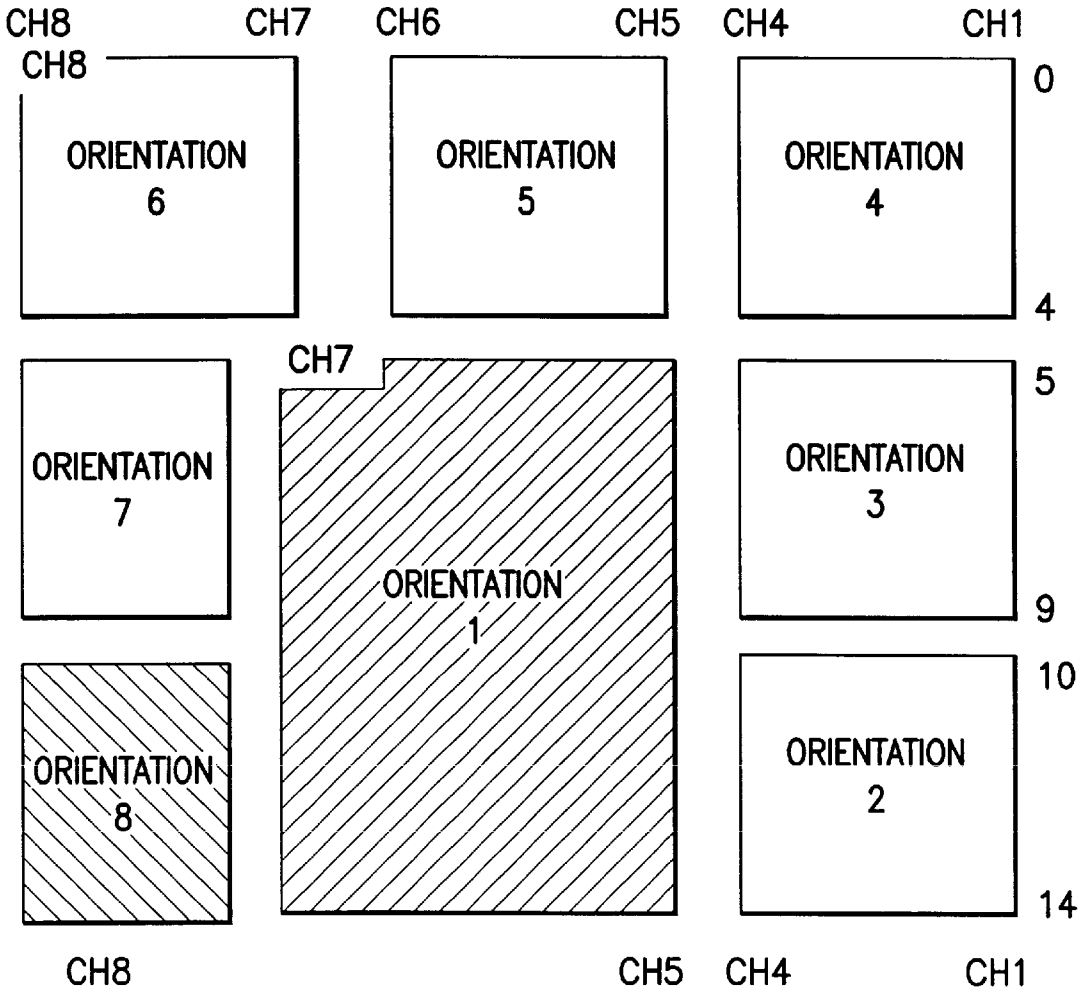
FIG. 13 is a drawing showing the coordinates defined in FIG. 12 divided into eight regions associated with the orientations of the auxiliary antenna.

Referring now to FIG. 13, the controller 30, as described later, uses the detection output from the infrared sensor 7 to stop the rotation of the rotating antenna 20 so that the region F of the auxiliary antenna 21 is positioned directly under or near the position where it is assumed that food is placed. The coordinates defined in FIG. 12 are grouped into eight regions associated with the direction of the auxiliary antenna 21.

Figure 14:
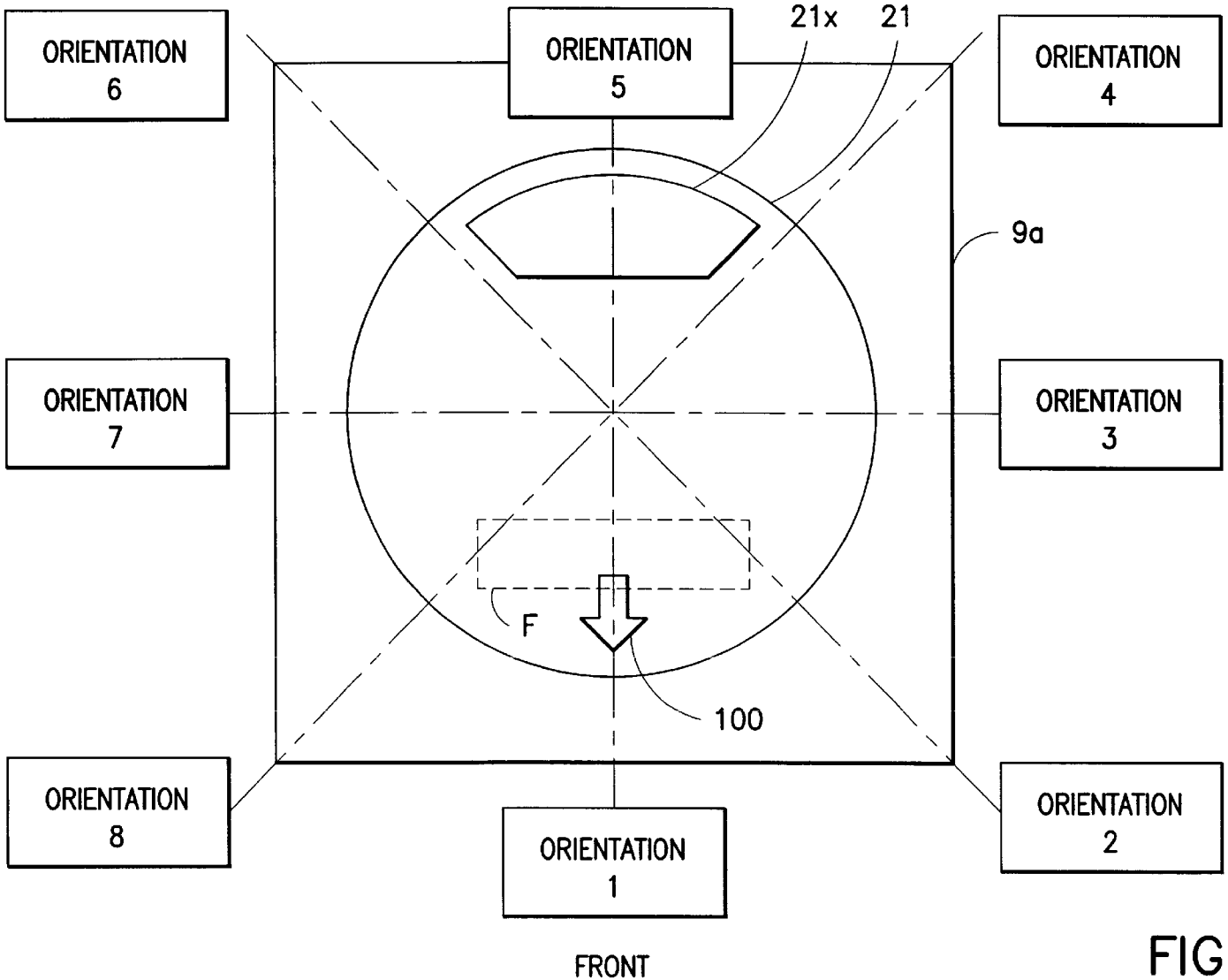
FIG. 14 is a drawing to which reference will be made in describing the orientation at which to stop the auxiliary antenna in the microwave oven of FIG. 1.

Referring to FIG. 14, the direction of the auxiliary antenna 21 is first assumed to be along an arrow 100. The arrow 100 points from the rotation center of the auxiliary antenna 21 toward the region F. Eight radial lines (dotted lines), extending from the rotation center of the auxiliary antenna 21, are labeled orientation 1–orientation 8. Initially, the auxiliary antenna 21 is assumed to be in orientation 1 extending radially from the center of the heating chamber 10 toward the front.

Orientation 2 through orientation 8 are defined in order going counterclockwise from orientation 1. For example, orientation 5 extends from the center of the heating chamber 10 toward the rear, and orientation 7 extends from the center of the heating chamber 10 to the left.

Returning to FIG. 13, the coordinates of the bottom surface 9*a* are divided into eight regions corresponding to orientation 1 through orientation 8. The coordinate regions corresponding to orientation 1 through orientation 8 are shown in Table 1.

TABLE 1

| | Coordinates of regions | |
|---|---|---|
| | x coordinate | y coordinate |
| Orientation 1 | CH5–CH7 | 5–14 |
| Orientation 2 | CH1–CH4 | 10–14 |
| Orientation 3 | CH1–CH4 | 5–9 |
| Orientation 4 | CH1–CH4 | 0–4 |
| Orientation 5 | CH5–CH6 | 0–4 |
| Orientation 6 | CH7–CH8 | 0–4 |
| Orientation 7 | CH8 | 5–9 |
| Orientation 8 | CH8 | 10–14 |

Referring to Table 1 and FIG. 13, if food is determined to be placed at y coordinate 11 of CH6, this point belongs to "orientation 1" and the microwave oven 1 stops the auxiliary antenna 21 in the direction of orientation 1 and begins heating operations.

As the orientation of the auxiliary antenna 21 changes, the position of the region F also changes. The region F is a region that receives microwave radiation more powerfully compared to other regions of the auxiliary antenna 21. If the food placement position is detected on the bottom surface 9*a,* the stopping orientation of the auxiliary antenna 21 is determined so that the region F is located at that position. In other words, the stopping position of the auxiliary antenna 21 is determined so that heating takes place most powerfully at the position where the food is assumed to be placed. The placement position of the food does not necessarily need to be detected by the microwave oven 1. For example, the user can enter the food placement position so that the stopping position of the auxiliary antenna 21 is determined based on the entered information and according to the relationship shown in FIG. 13.

The controller 30 also receives on/off information for the cam switch 90. Based on this information, the stopping positions of the rotating antenna 20 and the auxiliary antenna 21 are controlled. This stopping position control is described in detail.

Referring to Table 2, there is shown the times required to reach orientation 1 through orientation 8 once the cam switch 89 is actuated.

TABLE 2

| | Time for the antenna motor to stop after the cam switch is actuated | |
|---|---|---|
| | 50 Hz | 60 Hz |
| Orientation 1 | 1.42 | 1.18 |
| Orientation 2 | 1.67 | 1.39 |
| Orientation 3 | 1.93 | 1.61 |
| Orientation 4 | 0.12 | 0.10 |
| Orientation 5 | 0.38 | 0.32 |
| Orientation 6 | 0.64 | 0.53 |
| Orientation 7 | 0.90 | 0.75 |
| Orientation 8 | 1.16 | 0.96 |

Referring to Table 2, for a 60-Hz power supply frequency, the controller 30 stops the antenna motor 16 1.18 seconds after the cam switch 89 is actuated in order to stop the auxiliary antenna 21 at orientation 1.

Thus, by stopping the antenna motor 16 according to the times after the cam switch 89 is actuated as shown in Table 2, the stopping positions of the auxiliary antenna 21 are controlled by the controller 30 for orientation 1 through orientation 8.

The controller 30 is also connected to a search counter 32. The search counter 32 counts the number of searches performed by the infrared sensor 7. The search count of the infrared sensor 7 refers to the number of times the temperature has been detected for the entire area of the bottom surface 9*a* of the heating chamber 10. Referring to FIG. 7 and FIG. 9, in this embodiment this count is the number of times the fields of view 70*a* move from the position indicated by the solid lines to the position indicated by the dotted lines or from the dotted lines to the solid lines.

The infrared sensor 7 is equipped with multiple infrared detection elements 7*a*. The infrared sensor 7 is also equipped with a memory 7*x* for storing data used to correct detection errors in each lot. When power is first turned on, the controller 30 stores the correction data stored in the memory 7*x* in a non-volatile memory 33 disposed separately from the infrared sensor 7. As a result, the parts used in the memory 7*x* do not require high heat resistance even if the infrared sensor 7 is attached to a position in the infrared sensor 7 that will experience relatively high temperatures. In other words, the memory 7*x* does not have to be heat-resistant and can be inexpensive. Thus, by having the controller 30 transfer the contents of the memory 7*x* to the non-volatile memory 33, the cost of the microwave oven 1 is reduced.

4. Operations Performed by the Microwave Oven

1) Standard operations

Next, the operations performed by the microwave oven 1 after power is turned on is described with reference to the flowcharts in FIG. 15 and FIG. 16.

Initialization takes place at S1 when power to the microwave oven 1 is turned on. The first time the power is turned on for the microwave oven 1, the storage contents of the memory 7*x* is stored in the non-volatile memory 33 at S1 as described above. In the microwave oven 1, power is turned on as a result of predetermined key operations on the input panel 6 or when the door 3 is opened from the closed state.

Next, at S2, a count value for an auto-poweroff timer is reset. The auto-poweroff timer counts down periods during which no operation is performed on the microwave oven 1 and during which the microwave oven 1 performs no operations. When the timer is decremented to 0, the power to the microwave oven 1 is automatically turned off.

Next, at S3, the countdown of the T off is started.

Next, at S4, the Toff count value is checked to see if it is 0. If so, power from the power supply to the microwave oven 1 is turned off at S22 and the operation is exited. If the counter has not reached 0, control proceeds to S5.

At S5, the door 3 is checked to see if it is open. If so, control returns to S2. In other words, the Toff continues to be reset as long as the door 3 is open. If the door is closed, control proceeds to S6.

S6 checks to see if an entry has been made to any of the keys on the input panel 6. If so, the Toff is reset at S7 and control proceeds to S8. Otherwise, control returns to S4.

The various keys described below are disposed on the input panel 6 and operations performed on these keys are transferred by the input module 60 to the controller 30.

S8 determines if the pressed key is the "Heat key". The "Heat key" is a key used when heating standard food. When this key is used, the microwave oven 1 detects the status of the food and automatically determines when to stop heating. If a "Heat key" operation is detected, control proceeds to S9. If another key operation was detected, control proceeds to S12.

S9 determines if heating condition settings were entered with other key operations after the "Heat key" was pressed. If so, control proceeds to S11 to perform operations associated with these other keys, and control then returns to S2. If there are no further heating condition settings, an evaluation is made to determine if an operation was entered to start heating. If so, control proceeds to S10.

At S10, once the operation associated with the automatic heating option is performed, control returns to S2. The operation associated with the automatic heating option is described later with reference to FIG. 17 and FIG. 18.

S12 determines if the entered key was the "Speed key". The "Speed key" is a key used to provide quick heating. If the "Speed key" was pressed, control proceeds to S13. If another key was pressed, control goes to S14.

At S13, the operations associated with the speed heating option are performed and control returns to S2. The operations associated with the speed heating option is described later with reference to FIG. 19.

S14 determines if the "Cancel key" was pressed. If so, S15 cancels the content that was set up through key entry and control returns to S2. If a different key was pressed, control proceeds to S16.

S16 determines if the "Custom temperature key" was pressed. The "Custom temperature key" is used to heat food to the entered temperature. If the "Custom temperature key" was pressed, control proceeds to S17. Otherwise, control proceeds to S18.

S18 determines if the "Tuber key" was pressed. The "Tuber key" is used to heat tubers such as potatoes. If the "Tuber key" was pressed, control proceeds to S19. Otherwise, control proceeds to S20.

S20 determines if the entered key was a key other than those checked for up to S18. If so, control proceeds to S21, where operations associated with other key operations are performed, and control returns to S2. Otherwise, control goes to S4.

At S17, after performing the operations associated with the custom temperature option, control proceeds to S2. At S19, after performing the operations associated with the tuber option, control proceeds to S2. The operations associated with the custom temperature option and the tuber option is described later with reference to FIG. 20 and FIG. 21.

2) Operations associated with the automatic heating option

Figure 15:
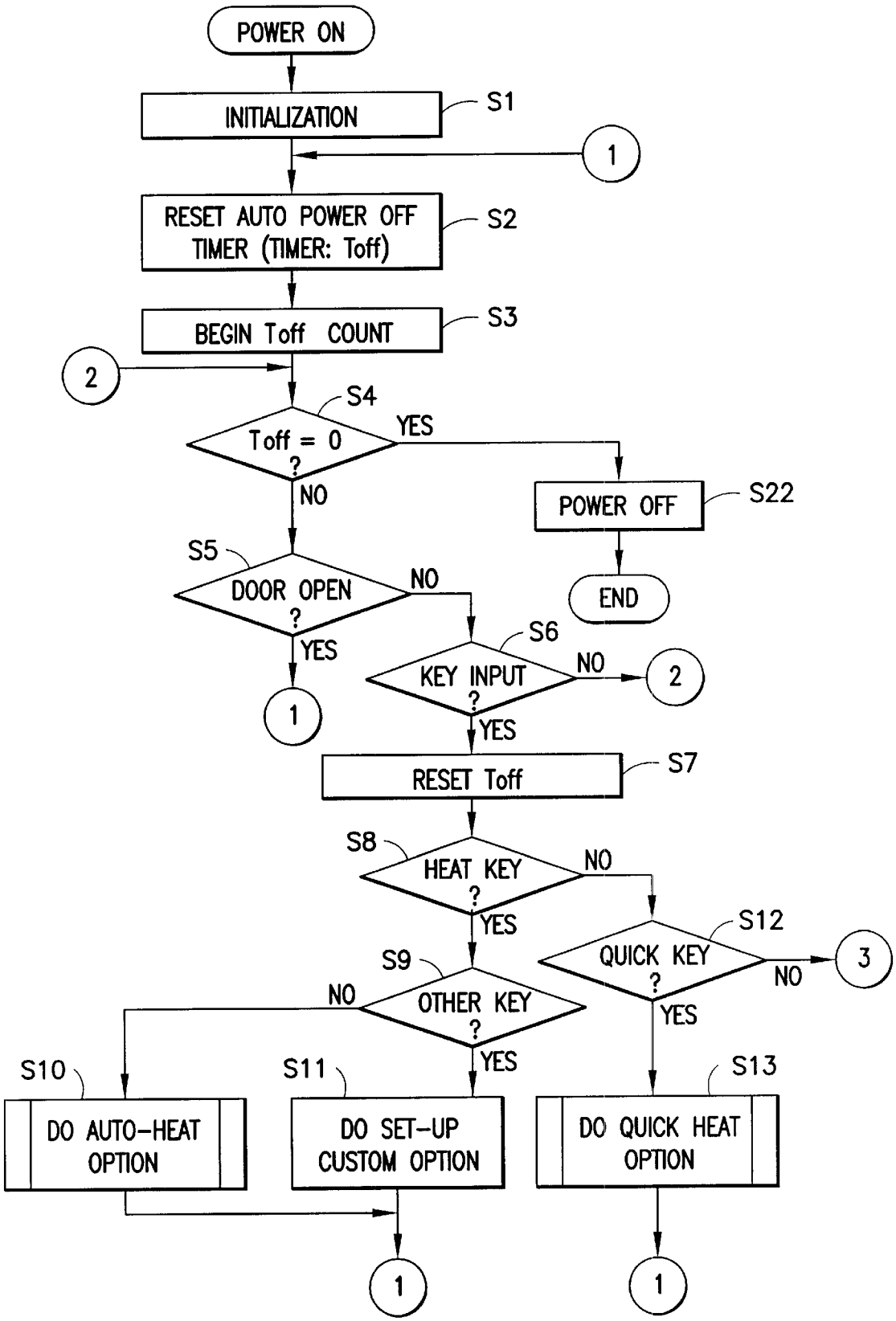
FIG. 15 is a flowchart showing the operations performed when power is turned on in the microwave oven of FIG. 1.
Figure 16:
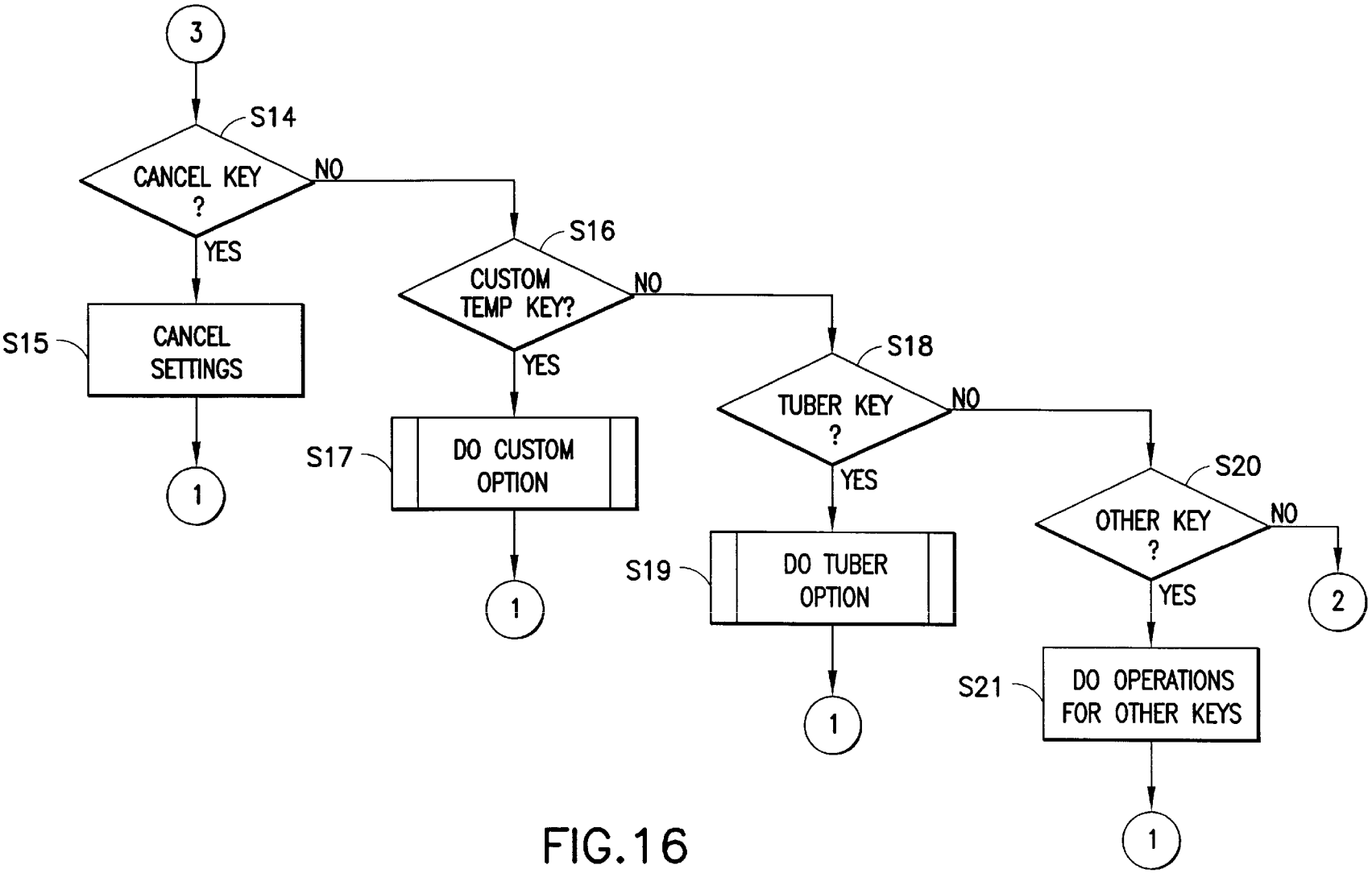
FIG. 16 is a continued flowchart showing the operations performed when power is turned on in the microwave oven of FIG. 1.
Figures 17, 17A, 17B:
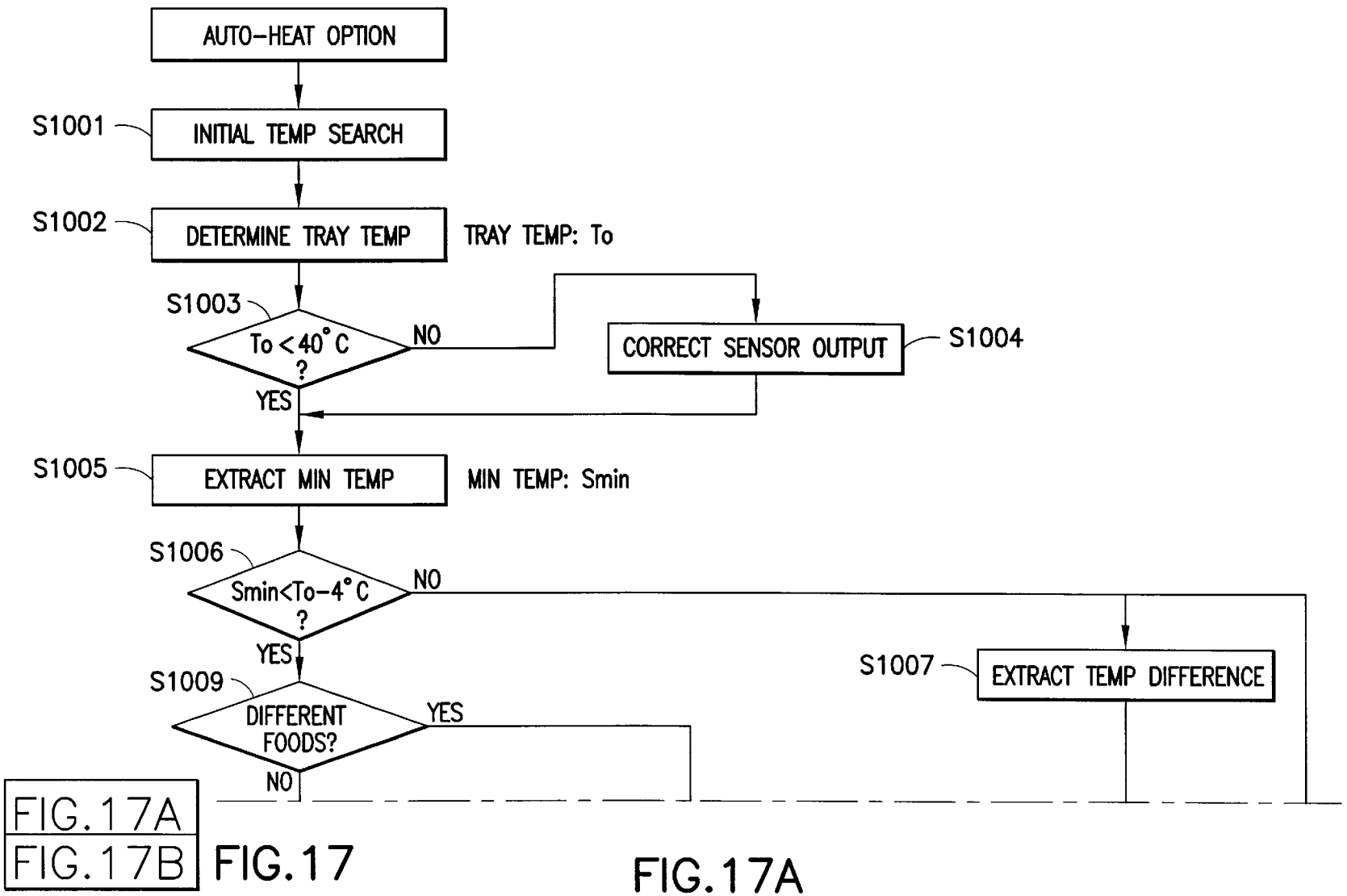
FIG. 17 is a flowchart of a subroutine for the automatic heating option operations of FIG. 15.
Figure 17B:
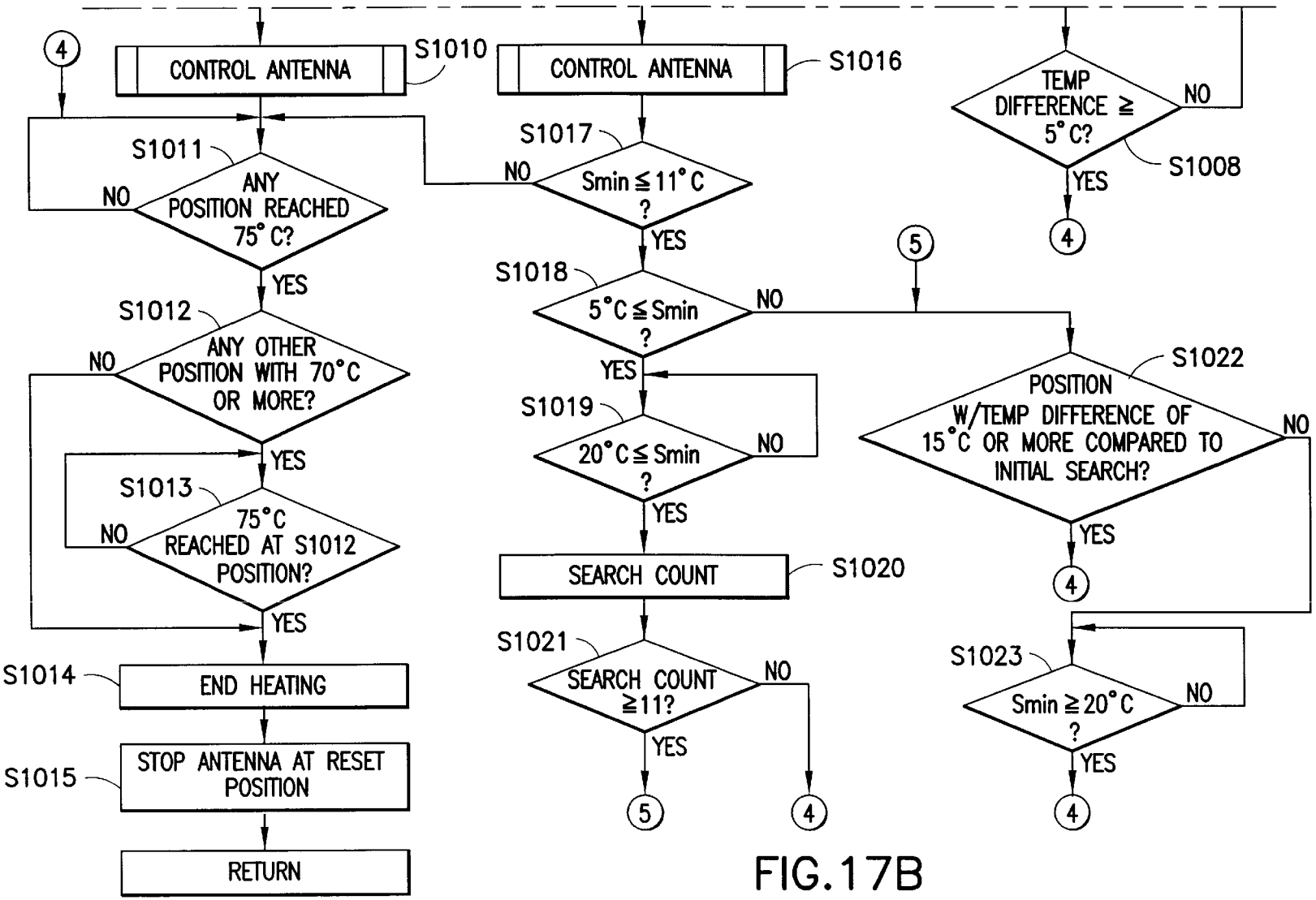

Referring to FIG. 17, the operations associated with the automatic heating option subroutine referenced in FIG. 15 (S10) is described.

First, at S1001, the magnetron 12 starts heating operations and an initial temperature search is performed over the entire bottom surface 9*a* (y coordinates 1–14 for CH1–CH8). The heating operation is performed by the magnetron 12 while the rotating antenna 20 and the auxiliary antenna 21 are continuously rotated.

Next, at S1002, the temperatures for the four points R1 through R4 from FIG. 12 based on the detection output from S1001 are used to calculates a tray temperature T0. The highest temperature and the lowest temperature are ignored. The remaining two values are averaged to calculate the tray temperature T0.

Next, S1003 determines if T0 is at least 40 deg C. If not, control proceeds from S1004 to S1005. If the temperature T0 is at least 40 deg C., control proceeds directly to S1005.

At S1004, correction is performed on the output values from the infrared sensor 7 and control proceeds to S1005. More specifically, this correction involves subtracting from the detected temperature the amount that the tray temperature is believed to have offset the detection. The fields of view 70*a* of the infrared detection elements of the infrared sensor 7 include both the food and the bottom surface 9*a*. Thus, this correction minimizes the influence that the temperature of the heating chamber 10 itself has on the detection of the temperature of the food.

An alternative method for preventing the temperature of the heating chamber 10 itself from being detected as the food temperature is to use the tray temperature T0 as a temperature detection reference value or baseline, and then to have the infrared sensor 7 output the difference between the detected temperature and the tray temperature at each detection position in the heating chamber 10.

At S1005, the minimum temperature Smin is extracted from the temperature detected at S1001.

Next, S1006 determines whether Smin is lower than (T0—4 deg C.). If so, control proceeds to S1009. If Smin is at least (T0—4 deg C.), the operation proceeds to S1007.

S1007 extracts the temperature difference between the maximum temperature of the bottom surface 9*a* and the minimum temperature. S1008 determines whether this temperature difference is at least 5 deg C. The operations at S1007 and S1008 are continued until the temperature difference is found to be at least 5 deg C. If the temperature difference is found to be at least 5 deg C., the operation proceeds to S1011.

S1009 determines whether different types of food are placed in the heating chamber 10. The food types referred to here can include frozen food, cooled food, and room-temperature food. The presence of different types of food in the heating chamber 10 is determined using the temperature distribution on the bottom surface 9*a*. If different types of food are found in the heating chamber 10, the operation proceeds to S1016. Otherwise, the operation proceeds to S1010.

Figures 18, 18A:
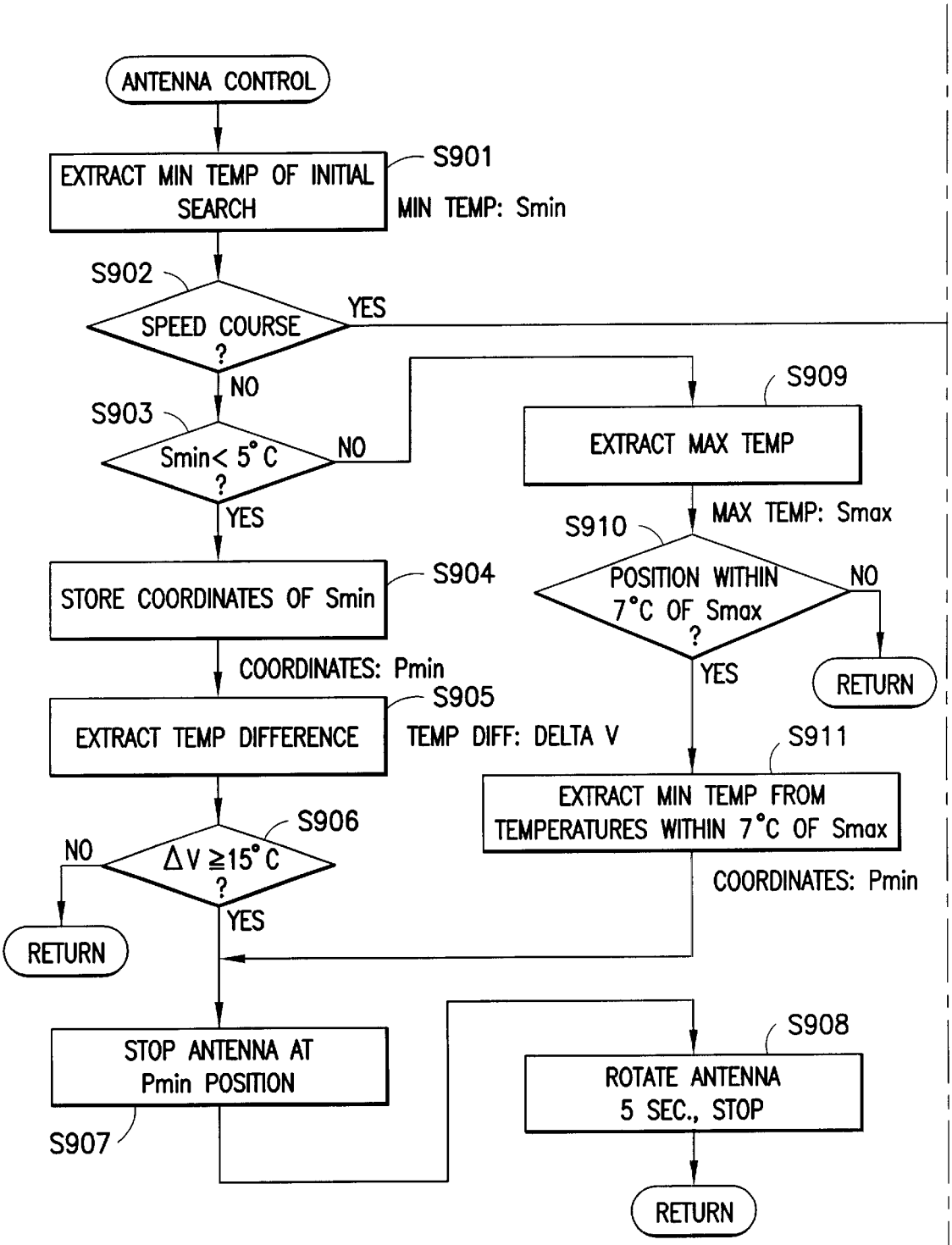
FIG. 18 is a flowchart of a subroutine for the antenna control operations of FIG. 17.
Figure 18B:
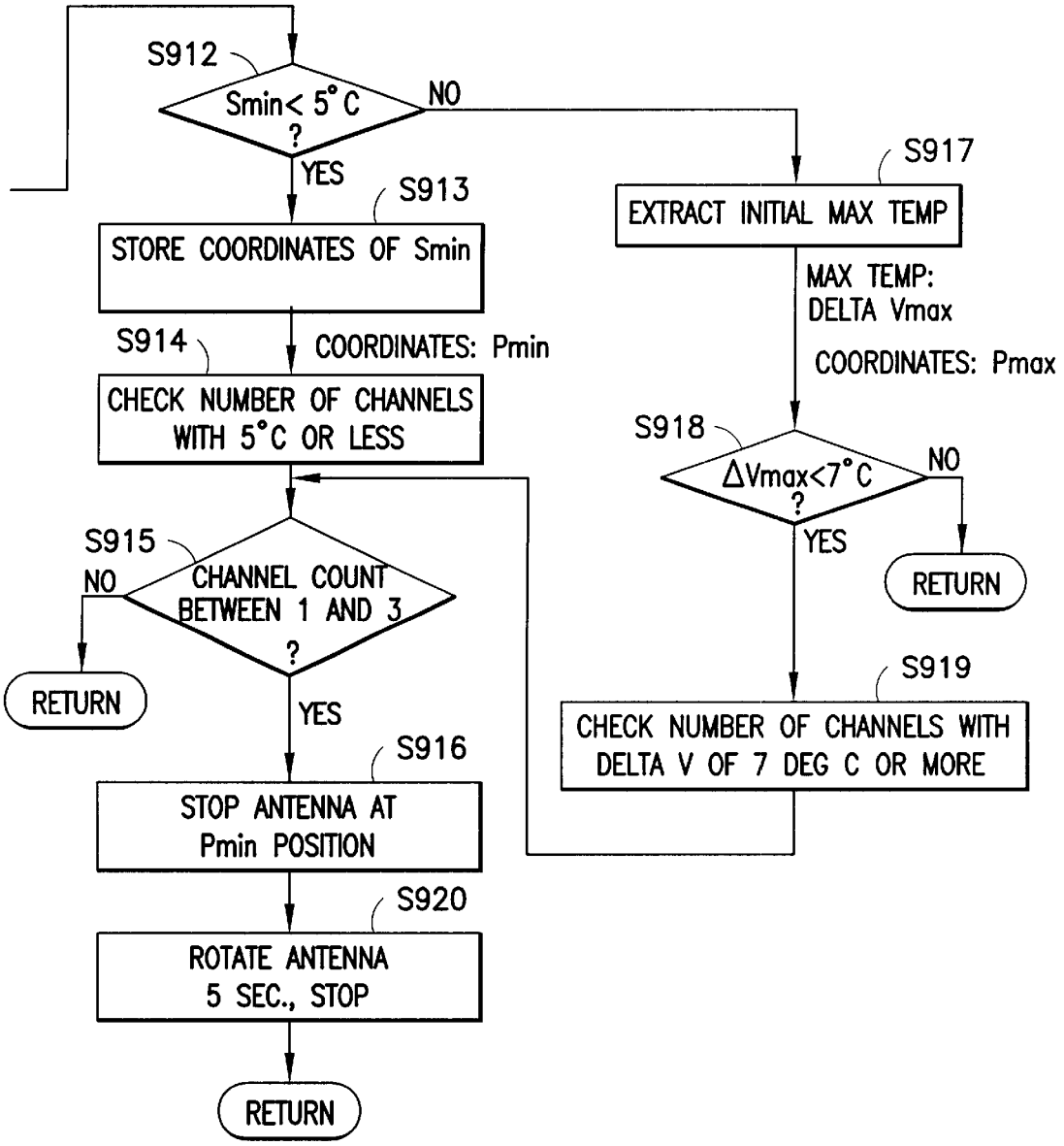

At S1010 and S1016, once the antenna control operation is executed, the operations proceed to S1011, S1017 respectively. Referring to FIG. 18, the antenna control operations is described in detail.

Referring to FIG. 18, there is shown a flowchart of the subroutine for the antenna control operation (S1010, S1016) from FIG. 17.

In the antenna control operation, S901 first extracts Smin in the same way as in S1005 (see FIG. 17).

Next, the operation currently being executed is checked to determine if it is the quick heating option. If so, the operation proceeds to S912. Otherwise, the operation proceeds to S903.

S903 determines if Smin is less than 5 deg C. If so, the operation proceeds to S904. Otherwise, the operation proceeds to S909.

At S904, the coordinates at which Smin was detected (Pmin: the channel and the y coordinate values) is stored in the controller 30.

Next, at S905, the temperature increase at Pmin within a certain time period is detected (detected temperature difference delta V). The certain time period can, for example, be a period during which the entire bottom surface 9*a* of the heating chamber 10 is detected a certain number of times. This can be measured using the output from the search counter 32. As a more specific example, the time for three scans of the temperature of the bottom surface 9*a,* approximately 5 seconds, can be used.

Next, S906 checks if delta V is at least 15 deg C. If so, the operation proceeds to S907. Otherwise, the subroutine returns.

At S907, the auxiliary antenna 21 is stopped at an orientation (see Table 1) corresponding to the position Pmin. At S908, the magnetron 12 performs heating operations continuously while every five seconds the auxiliary antenna 21 switches between stopping at the orientation from S907 and resuming rotation. The subroutine then returns. As a result, the auxiliary antenna 21 is stopped to provide concentrated heating for the low-temperature food in the heating chamber 10 while also allowing the auxiliary antenna 21 to rotate so that the remainder of the heating chamber 10 is evenly heated. If there are multiple Pmin points, Pmin is set to the central position of the multiple Pmin points and the operation is continued.

The status switching interval of five seconds is set as an integer multiple of the time it takes to perform a temperature scan of the entire bottom surface 9*a*. In other words, the control timing for the elements in the microwave oven 1 is synchronized with the timing for the completion of a temperature scan for the entire heating chamber 10 by the infrared sensor 7. As a result, changes in the heating conditions for the food in the heating chamber 10 is prevented during the intervals for which the search counter 32 counts up by one, i.e., the intervals during which the fields of view 70*a* move once from the dotted line position to the solid line position or from the solid line position to the dotted line position. Thus, temperature detection for the heating chamber 10 can take place under consistent conditions during a single count of the search counter 32. Referring to FIG. 7 and FIG. 9, the manner in which the fields of view 70*a* move just once from the dotted line to the solid line or the solid line to the dotted line is referred to as the search pattern of the infrared sensor 7 for the entire heating chamber 10.

Thus, in this embodiment, the timing at which the control format for the elements associated with heating operations changes is synchronized with the starting or ending of a search pattern for the entire heating chamber 10 by the infrared sensor 7. The elements associated with heating operations include the magnetron 12, the rotating antenna 20, and the auxiliary antenna 21.

If S906 determines that delta V is less than 15 deg C., the auxiliary antenna 21 is left rotating and the subroutine returns. This is because if delta V is determined to be less than 15 deg C., the food item is assumed to be relatively large, or relatively uniformly heated, indicating that there is no need to fix the orientation of the auxiliary antenna 21 to provide localized heating.

S909 extracts the maximum temperature Smax of the bottom surface 9*a*.

Next, S910 determines if a position with a temperature within 7 deg C. of Smax was detected on the bottom surface 9*a*. If no such position was found, the subroutine returns. Otherwise, the operation proceeds to S911. In this evaluation, the channels adjacent to the channel where Smax was detected are excluded.

S911 extracts the minimum temperature of the positions at which temperatures within 7 deg C. of Smax were detected. The position at which the minimum temperature was detected is set up as Pmin and the operation proceeds to S907.

In the operations at S909 through S911, if multiple food items are placed in the heating chamber 10, S910 detects the positions of the food items that are least easily heated, up to the second most easily heated food item. Of these, concentrated heating is performed on the position with the lowest degree of heat in S911, S907, and S908. The reason the evaluation at S910 is done within 7 deg C of Smax is so that the tray temperature is not included in the position temperatures. If the temperature difference from Smax exceeds 7 deg C., it is likely that the temperature is the tray temperature. The value of 7 deg C. is an example. The temperature range for which evaluation is to be performed can be changed, e.g., according to the shape of the microwave oven 1.

S912 determines whether Smin extracted at S901 is less than 5 deg C. If so, the operation proceeds to S913. Otherwise, the operation proceeds to S917.

At S913, the coordinates of the position at which Smin was detected are stored in the controller 30.

The temperature detection for the heating chamber 10 includes CH1 through Ch8. S914 checks the number of channels in which a temperature of 5 deg C was detected at least once for the y coordinates 1–14.

S915 determines if the number of channels found at S914 is between 1 and 3. If so, the operation proceeds to S916. Otherwise, the subroutine immediately returns.

As in S907, S916 stops the auxiliary antenna 21 at the orientation corresponding to the position of Pmin (see Table 1). Then, at S920, the magnetron 12 performs heating operations continuously while every five seconds the auxiliary antenna 21 switches between being stopped (S916) and resuming rotation. The subroutine then returns.

Thus, the heating operations performed at S915, S916, and S920, including localized heating of specific areas in the heating chamber 10, are performed only if between one and three CH are detected with temperatures of 5 deg C. or less similar to Smin when S913–S916 and S920 were executed.

At S917, the current detected temperature is compared with the temperature at the start of the heating operation as detected at S1001 (see FIG. 17). The coordinates Pmax for the location with the largest temperature increase and the temperature increase delta Vmax are extracted.

Next, S918 determines whether delta Vmax is less than 7 deg C. If so, the operation proceeds to S919. Otherwise, the subroutine immediately returns.

As in S917, S919 compares detected temperatures to calculate the temperature increases for each position. Then, the number of channels containing temperature increases of at least 7 deg C. are calculated. If, for example, CH3 and CH4 contained positions with temperature increases of at least 7 deg C., a channel count of "2" is calculated.

Next, S915 determines if the channel count calculated at S919 is between 1 and 3. Depending on the result, the subroutine can return immediately or the operation may proceed to S916.

Referring to FIG. 17, S 1017 determines whether Smin is 11 deg C. or less. If so, the operation proceeds to S1018. Otherwise, the operation proceeds to S1011.

S1018 determines if Smin is at least 5 deg C. If so, the operation proceeds to S1019. Otherwise, the operation proceeds to S1022.

S1019 waits for Smin to reach 20 deg C., and the operation then proceeds to S1020.

At S1020, the value of the search counter 32 is checked. S1021 determines if the counter value is at least 11. If so, the operation proceeds to S1022. Otherwise, the operation proceeds to S1011.

S1022 determines whether the current temperature detection results for the entire heating chamber 10 contain a position where the temperature has increased at least 15 deg C. compared to the temperature detection performed at S1001. If so, the operation proceeds to S1011. Otherwise, the operation proceeds to S1023.

S1023 waits for Smin to reach 20 deg C., and then the operation proceeds to S1011.

S1011 waits for any position on the bottom surface 9*a* to reach 75 deg C., and then the operation proceeds to S1012. In this case, 75 deg C. is the temperature at which to stop heating in the automatic heating option, i.e., food is heated to 75 deg C. in this option.

S1012 determines whether where there is a position different from the one detected at S1011 where a temperature of at least 70 deg C. is detected. If so, the operation proceeds to S1013. Otherwise, the operation proceeds to S1014.

S1013 waits for the detected temperature at the position detected at S1012 to reach 75 deg C. Then the operation proceeds to S1014.

At S1014, the heating operation performed by the magnetron 12 is stopped. At S1015, the auxiliary antenna 21 is stopped at "orientation 1" (the reset position), and the subroutine returns.

In the operations performed in S1011 through S1014, when the temperature of any position in the heating chamber 10 reaches 75 deg C. and the heating for the food at that position is considered to be completed, the other positions are checked for temperatures of at least 70 deg C. If a position is found with a temperature of less than 70 deg C., the operation waits for the temperature of that position to reach at least 75 deg C., and then the heating operation is stopped. As a result, even if multiple food items are placed in the heating chamber 10, the time at which to stop the heating operation is determined in an appropriate manner so that all food items can be heated.

In the operation at S1012, all positions other than the one detected at S1011 were used. However, it is also possible to exclude the channels for the positions detected by S1011 so that the same food item as the one detected at S1011 is not used again.

3) Operations associated with the quick heating option

Figure 19:
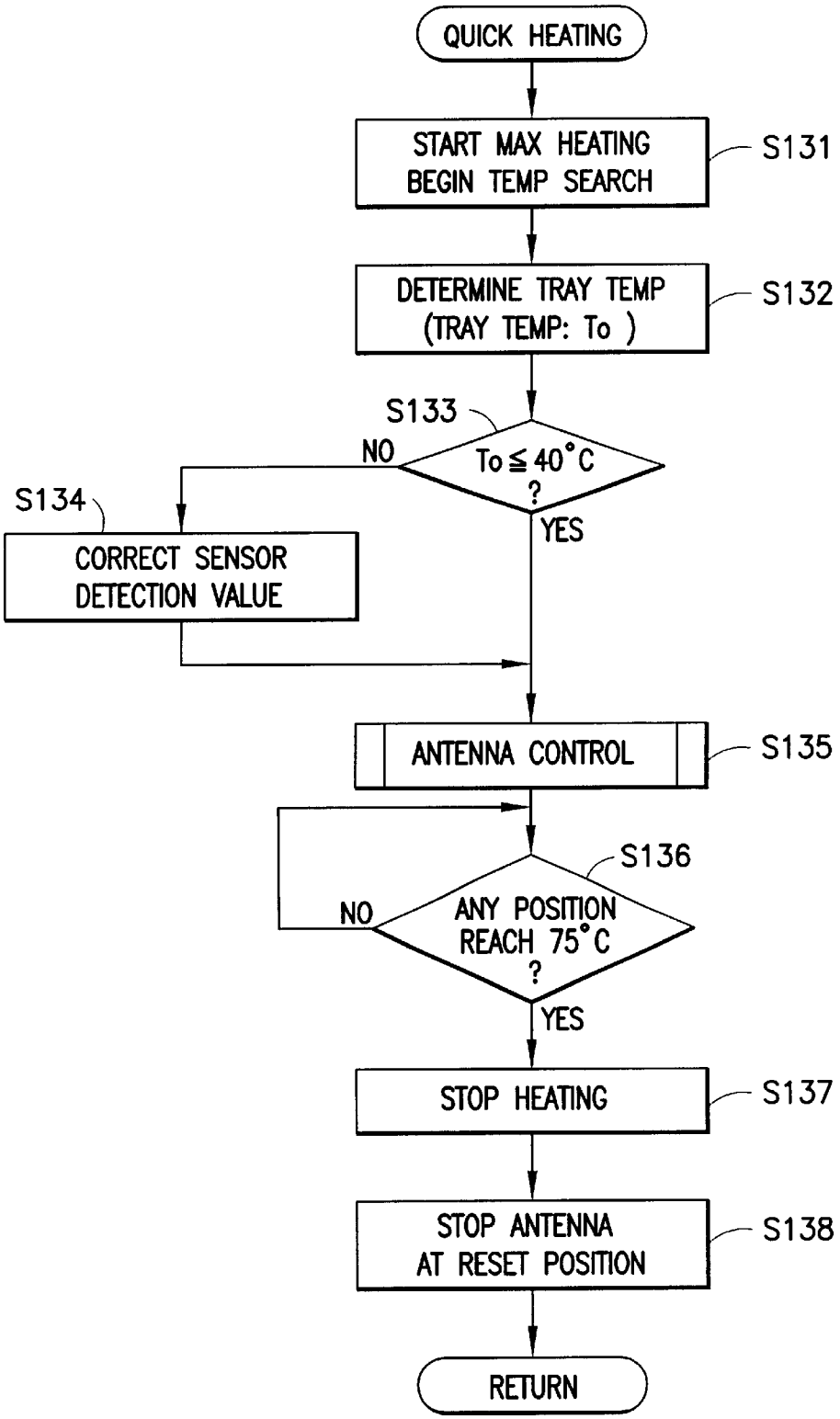
FIG. 19 is a flowchart of a subroutine for the quick heating option operations of FIG. 15.

The operations associated with the quick heating option is described. Referring to FIG. 19, there is shown a flowchart of a subroutine of the quick heating option operation (S13) from FIG. 15.

At S131, the magnetron 12 begins heating operations at maximum output, the auxiliary antenna 21 is rotated, and temperature detection for the entire bottom surface 9*a* is started. Next, at S132, the tray temperature T0 is determined in the same manner as in S1002 (see FIG. 17).

Next, S133 determines whether T0 is 40 deg C. or less. If so, the operation proceeds to S135. Otherwise, at S134, correction of the detection output from the infrared sensor 7 is performed in the same manner as in S1004 (see FIG. 17). The operation then proceeds to S135.

At S135, the antenna control operation described using FIG. 18 is performed.

When the antenna control operation is performed in the quick heating option subroutine, the operations at S912 through S920 perform the following operations. Based on the size of the area in which food is believed to be present (the number of channels calculated in S914 or S919), an evaluation is made (S915) on whether or not to perform heating control operations including concentrated heating of the area where the food is assumed to be placed (S920).

Next, S136 waits for the temperature at any position to reach 75 deg C., and the operation proceeds to S137.

At S137, the heating operation performed by the magnetron 12 is stopped. Next, S138 stops the rotation of the auxiliary antenna 21 at the reset position.

4) Operations associated with the custom heating option

Figures 20, 20A, 20B:
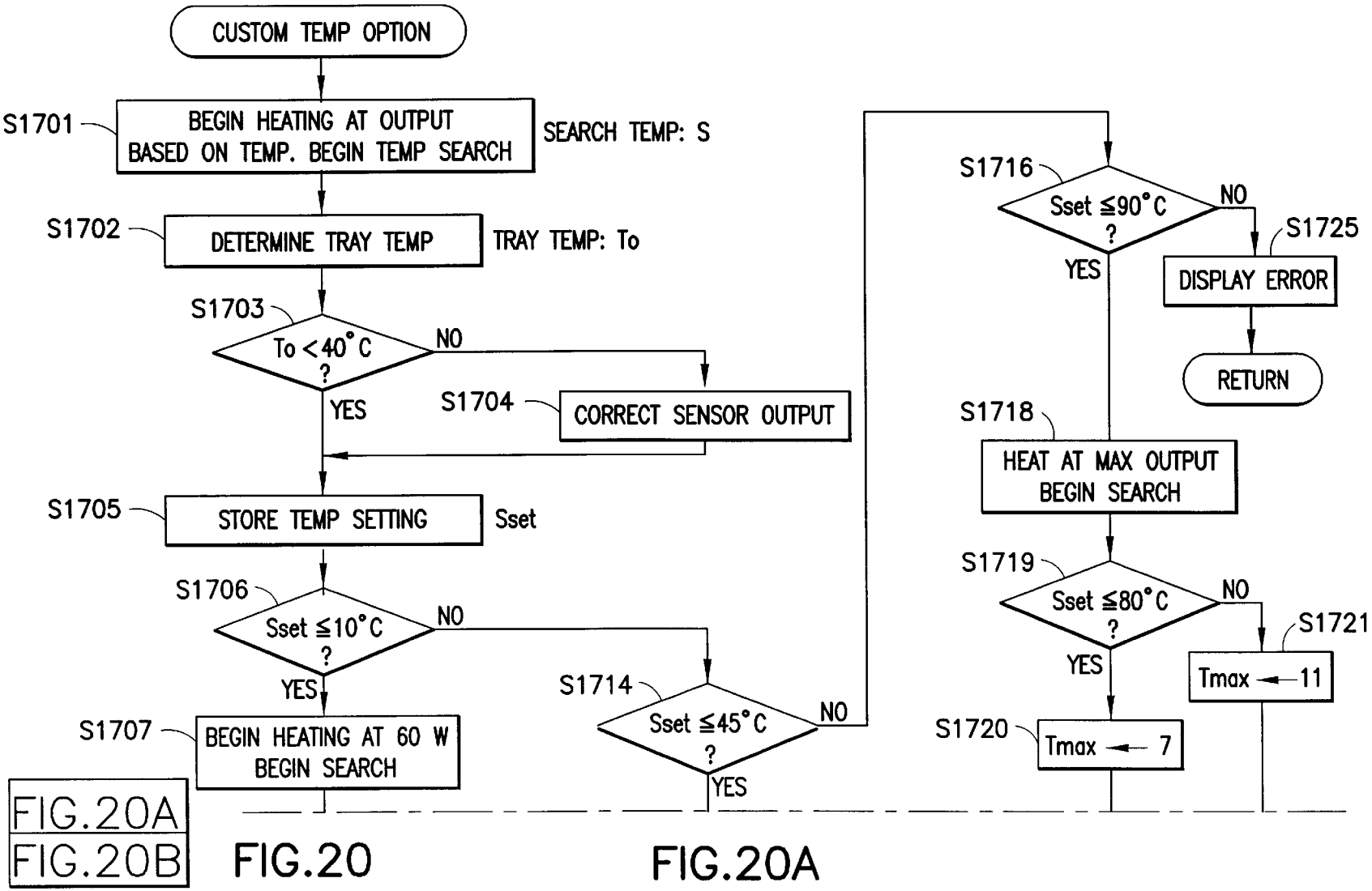
FIG. 20 is a flowchart of a subroutine for the custom heating option operations of FIG. 15.
Figure 20B:
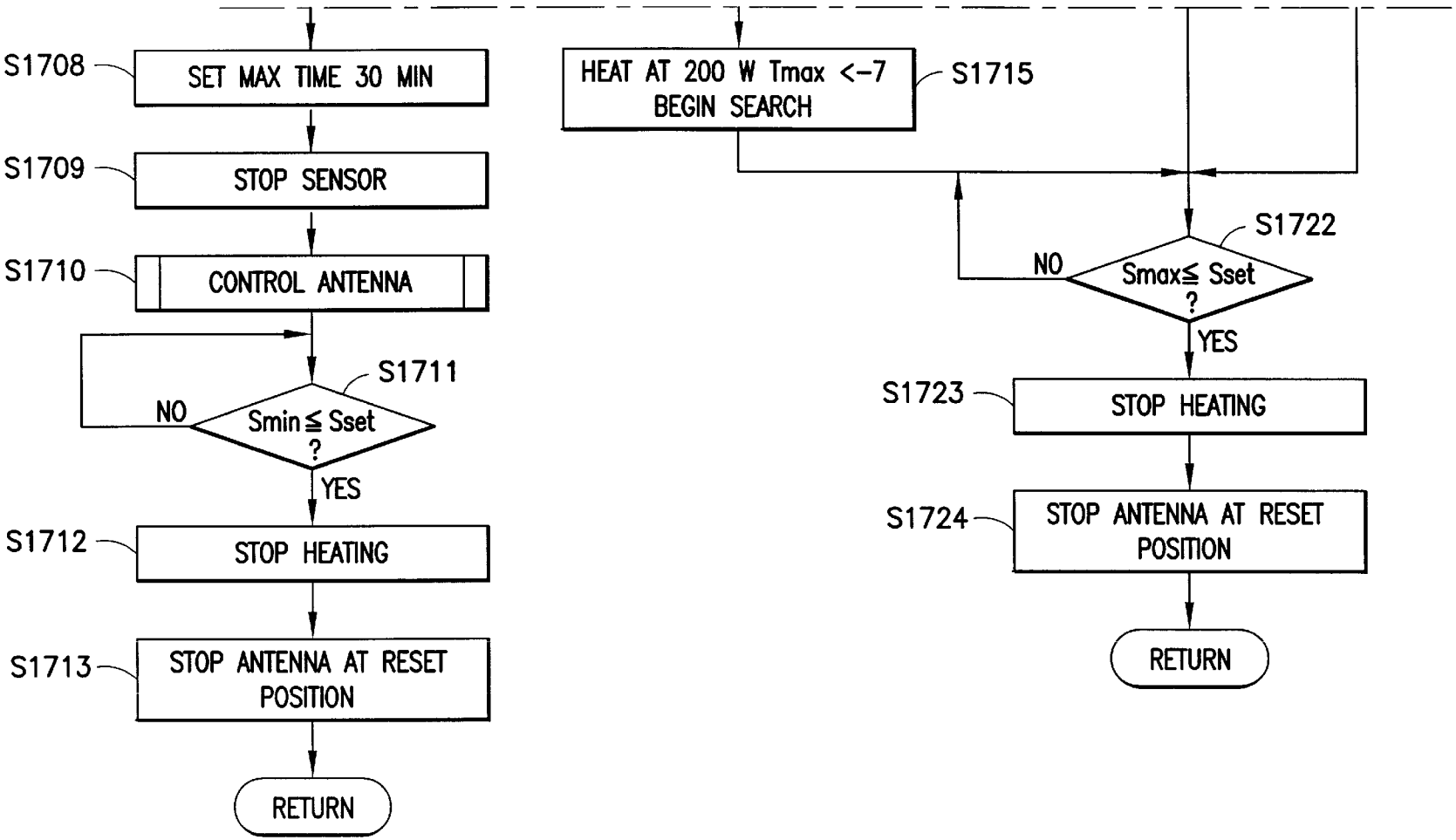

The operations associated with the custom heating option are described. Referring to FIG. 20, there is shown a flowchart of the subroutine for the custom temperature option operations (S17) from FIG. 16.

First, at S1701, heating is begun at maximum output, the auxiliary antenna 21 is rotated, and temperature detection for the entire bottom surface 9*a* is begun. Next, at S1702, the tray temperature T0 is determined in the same manner as in S1002 (see FIG. 17).

Next, S1703 determines whether T0 is less than 40 deg C. If so, the operation proceeds to S1705. Otherwise, at S1704, correction is applied to the detection output from the infrared sensor 7 in the same manner as in S1004 (see FIG. 17). Then, the operation proceeds to S1705.

At S1705, the temperature entered by the user (temperature setting: Sset) is stored in the controller 30.

Next, S1706 determines if Sset is 10 deg C. or less. If so, the operation proceeds to S1707. Otherwise, the operation proceeds to S1714.

At S1707, the heat output from the magnetron 12 is changed to 60 W and temperature detection of the heating chamber 10 is continued. It is preferable for the heat output from the magnetron 12 to be changed to 60 W when a search pattern for the entire heating chamber 10 has been completed. Also, a heat output of 60 W is a relatively low output compared to the maximum output of the magnetron 12. For example, if the heating operation for frozen food or the like is to be stopped after it has been heated to a temperature of 10 deg C. or less, the microwave oven 1 lowers the output from the magnetron 12 and performs the heating operation.

Next, S1708 sets the maximum heating time Tmax to 30 minutes. As a result, the heating operation stops after thirty minutes have elapsed even if the infrared sensor 7 does not detect Sset in the heating chamber 10.

Next, at S1709, the infrared sensor 7 is fixed so that the fields of view 70*a* are positioned at the position where the minimum temperature Smin was detected at S1701.

Next, at S1710, the antenna control operation described using FIG. 18 is executed.

Next, S1711 waits for Smin to reach Sset and then the operation proceeds to S1712. If the time set in Tmax has elapsed from the starting time before Smin reaches Sset, the operation proceeds to S1712 without waiting for Smin to reach Sset.

At S1713, the rotation of the auxiliary antenna 21 is stopped and the subroutine returns.

S1714 determines whether Sset is 45 deg C. or lower. If so, the operation proceeds to S1715. Otherwise, the operation proceeds to S1716.

At S1715, the output from the magnetron 12 is changed to 200 W, the Tmax described above is set to 7 minutes, a search pattern for the entire heating chamber 10 is begun, and the operation proceeds to S1722. It is preferable for the change in output and the setting of Tmax at S1715 to be synchronized with the start of a search pattern.

S1716 determines whether Sset is 90 deg C. or less. If so, the operation proceeds to S1718. Otherwise, S1725 performs an operation to provide a display indicating that there was an error and then the subroutine returns.

At S1718, heating by the magnetron 12 at maximum output is continued and a search pattern for the entire heating chamber 10 is begun.

Next, S1719 determines whether Sset is 80 deg C. or less. If so, the operation proceeds to S1720, Tmax is set to 7 minutes, and the operation proceeds to S1722.

At S1721, Tmax is set to 11 minutes and the operation proceeds to S1722.

S1722 waits for Smax to reach Sset and the operation proceeds to S1723.

At S1723, after the heating operation by the magnetron 12 stops, the rotation of the auxiliary antenna 21 is stopped at the reset position and the subroutine returns.

With the custom temperature option operations described above, if S1706 determines that Sset is 10 deg C. or less, the fields of view 70*a* of the infrared sensor 7 are fixed to a position that includes the position where Smin was detected. This is done because Smin can be assumed to be lower than standard temperature and also sufficiently lower than the tray temperature. Thus, moving the fields of view 70*a* during the heating operation can lead to a significant error being introduced to Smin. This operation prevents reduced precision of detection output from the infrared sensor 7.

5) Operations associated with the tuber option

Figure 21:
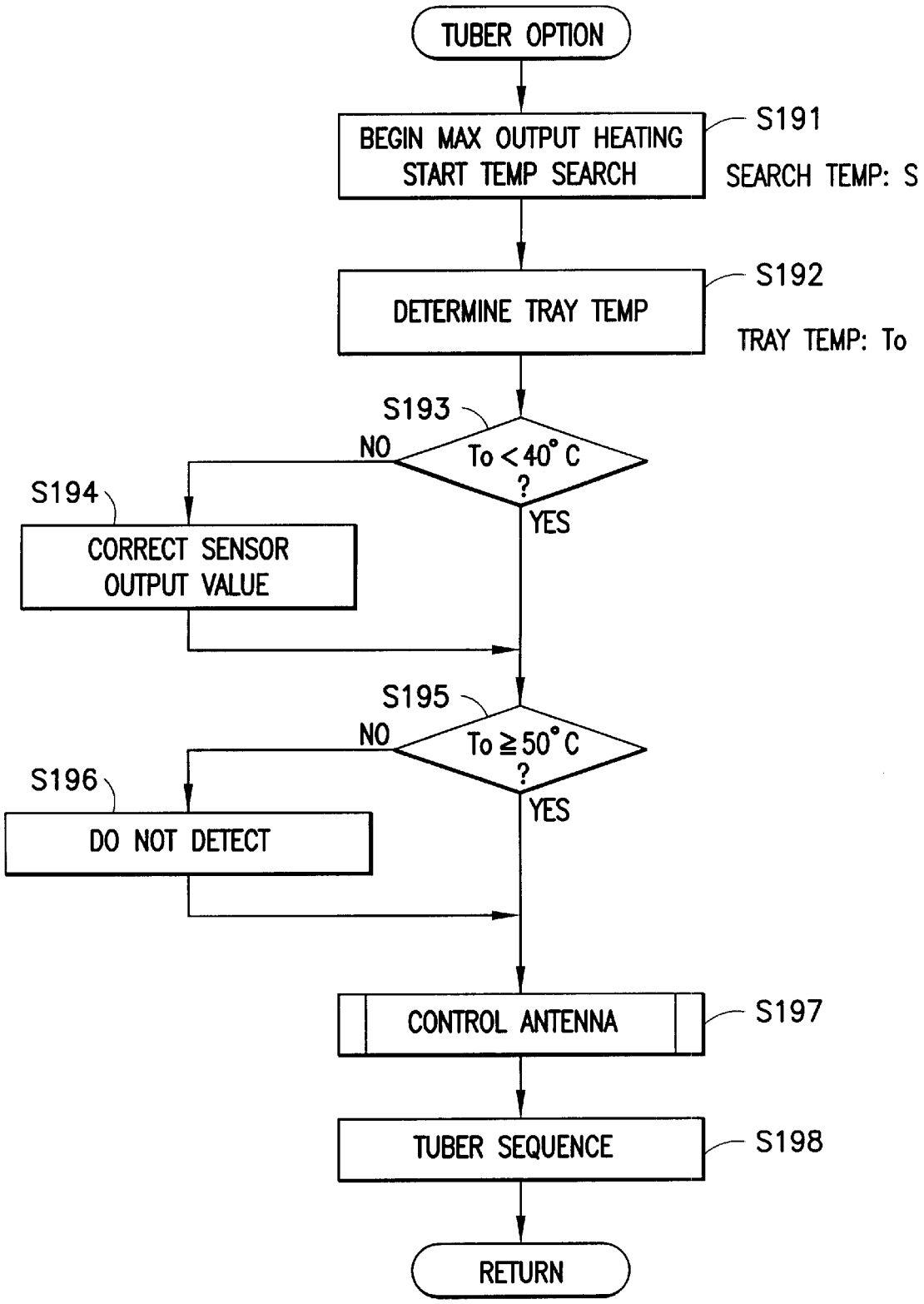
FIG. 21 is a flowchart of a subroutine for the tuber mode option of FIG. 16.

The operations associated with the tuber option is described. Referring to FIG. 21, there is shown a flowchart of the subroutine for the tuber option operations (S19) from FIG. 16.

At S191, the magnetron 12 begins performing heating operations at maximum output, while the auxiliary antenna 21 is rotated, and temperature detection for the entire bottom surface 9*a* is started. Next, S192 determines the tray temperature T0 in a manner similar to S1002 (see FIG. 17).

Next, S193 determines whether T0 is less than 40 deg C. If so, the operation proceeds to S195. Otherwise, at S194, correction is applied to the detection output from the infrared sensor 7 in the same manner as in S1004 (see FIG. 17), and the operation proceeds to S195.

S195 determines whether any position has a T0 of 50 deg C. or more. If such a position is found, the operation proceeds to S196. A setting is made to eliminate temperature detection from the current heating operation and the operation proceeds to 197. If no such position was found, the operation proceeds to S197.

At S197, the antenna control operation described using FIG. 18 is performed.

Next, at S198, the tuber sequence is executed, and the subroutine returns.

In the tuber sequence, heating is continued while the following operations are performed. First, the time it takes from the beginning of the heating operation to the time when any position in the heating chamber 10 reaches 80 deg C. is detected as T80. Then, once a position in the heating chamber 10 has reached 80 deg C., heating is continued for an interval determined by multiplying a predetermined coefficient to T80. In this tuber option sequence, if no position is determined to reach 80 deg C., the heating operation is stopped after a maximum of 5 minutes.

In the tuber option operations described above, positions with T0 at 50 deg C. at S195 are excluded from temperature detection. This is done to avoid errors in which areas already having high temperatures, e.g., areas on which hot food was placed, are detected as still containing hot food.

The examples described for the embodiment presented above are not restrictive, and the breadth of the present invention is defined by the scope of the claims rather than the descriptions above. The present invention includes all changes within the scope and equivalent scope of the claims.

Also, the technologies described for the different options can be applied to the microwave oven 1 by themselves or in combination.

Also, the number of infrared detection elements in the infrared sensor 7 is not restricted to eight and any number, including one, can be used. If necessary, the infrared sensor 7 can be moved in two dimensions, i.e., along two perpendicular directions, rather than just the one dimension indicated by the arrows 99 to scan an x/y field.

In the embodiment described above, the auxiliary antenna 21 could be stopped to any one of orientation 1 through orientation 8 depending on where the food to be heated in a concentrated manner is placed in the heating chamber 10. The position of the food to be heated in a concentrated manner is determined based on the detection output of the infrared sensor 7. However, in the microwave oven 1, it is also possible to predetermine the placement position for food to be heated in a concentrated manner. Alternatively, the position can be determined by the user each session by performing predetermined key operations on the input panel 6.

The specific temperatures recited above are merely exemplary. Some applications may employ other temperatures for control of heating direction and stopping. Also, the temperatures may be manually controllable instead of being fixed values.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A microwave oven comprising:

a heating chamber for holding food;

a microwave source to heat said food;

a temperature detector detecting temperatures at a plurality of locations in said heating chamber;

a controller controlling heating operations of said microwave source based on detection output from said temperature detector;

said controller including a first evaluation module;

said first evaluation module including means for evaluating whether a maximum temperature in said heating chamber detected by said temperature detector has reached a predetermined temperature when said microwave source is performing said heating operation;

a second evaluation module;

said second evaluation module including means which, if said first evaluation module determines that said maximum temperature in said heating chamber has reached said predetermined temperature, determines whether there is a particular position, other than said position that reached said predetermined temperature, in said heating chamber that has reached at least a predetermined temperature lower than said predetermined temperature;

a heating operation stopping module; and said heating operation stopping module including means, effective if said second evaluation module determines that there is said particular position, for stopping said heating operation of said microwave source when a temperature of said particular position reaches said predetermined temperature.

2. A microwave oven according to claim 1 further comprising:

a main unit storage module for storing information;

said main unit storage module being disposed separate from said temperature detector;

said temperature detector includes an infrared sensor;

a correction information storage module storing information used to correct detected temperature from said infrared sensor; and said controller includes means for storing storage contents of said correction information storage module in said main unit storage module when a first operation is performed.

3. A microwave oven according to claim 1 further comprising:

a temperature detection controller; and said temperature detection controller including means for controlling said temperature detector to repeatedly change a position at which to perform temperature detection using a predetermined pattern wherein;

means, in said controller, effective while said microwave source is performing heating operations, for synchronizing operations on other elements associated with said heating operation with a start of execution by said temperature detection controller of temperature detection according to said predetermined pattern.

4. A microwave oven according to claim 1 wherein:

said controller further includes a placement position determining module;

said placement position determining module including means effective, when a temperature detected by said temperature detector is outside a certain range, to determine a food placement position;

said food placement position being a position at which said temperature was detected; and if said temperature at said food placement position is lower by a predetermined temperature than a normal temperature, said temperature detection controller maintains a position at which said temperature detector module detects temperature at said food placement position while said microwave source is performing heating operations.

5. A microwave oven according to claim 1 wherein said temperature detector includes means for applying correction to temperatures at a plurality of positions in said heating chamber based on a temperature at a position in said heating chamber where food is absent when said microwave source begins heating operations.

6. A microwave oven according to of claim 1 wherein said temperature detector includes means for detecting temperatures at a plurality of positions in said heating chamber using as a reference a temperature at a start of said heating operation of said microwave source for a position in said heating chamber at which food is absent.

7. A microwave oven according to of claim 1 wherein said temperature controller includes means for disabling detection output of said temperature detector when said heating operation by said microwave source is started, said controller disables output of said temperature detector for a location at which said temperature detector detects a temperature of at least a predetermined value.

8. A microwave oven comprising:

means for directing microwave energy in a plurality of selected radial directions;

means for sensing food temperatures in a plurality of locations in said oven;

said locations being related to said selected radial directions;

means for controlling said means for directing to direct said microwave energy along a one of said plurality of selected radial directions related to a one of said plurality of locations having a food temperature lower than a food temperature at other locations; and means for stopping said microwave energy when food at all of said locations containing food reach a predetermined temperature;

means for sensing a baseline temperature at at least one position in said oven in which food is absent at a beginning of operation of said microwave energy;

storing said baseline temperature to produce a stored baseline; and using said baseline temperature during heating of said food to correct sensed temperature of said food during heating.

9. Apparatus according to claim 8 wherein said means for sensing a baseline temperature includes:

means for sensing temperatures at at least four locations in said microwave oven at a start of heating;

means for discarding a maximum sensed temperature and a minimum sensed temperature; and means for averaging a remaining two sensed temperatures to produce said baseline temperature.

* * * * *